United States Patent [19]

Steeves et al.

[11] Patent Number: 4,811,882

[45] Date of Patent: Mar. 14, 1989

[54] RESTRICTIVE TRIGGER ACTUATED VALVE ARRANGEMENT FOR A FASTENER DRIVING TOOL

[75] Inventors: Jay M. Steeves; Eric H. Halbert, both of Cincinnati, Ohio

[73] Assignee: Sencorp, Cincinnati, Ohio

[21] Appl. No.: 113,597

[22] Filed: Oct. 26, 1987

[51] Int. Cl.[4] ..... B25C 1/04

[52] U.S. Cl. ..... 227/8; 227/130

[58] Field of Search ..... 227/8, 130, 120, 136; 91/461

[56] References Cited

U.S. PATENT DOCUMENTS

| | | | |
|---|---|---|---|
| 3,677,456 | 7/1972 | Ramspeck et al. | 227/8 |
| 3,677,457 | 7/1972 | Ramspeck et al. | 227/8 |
| 3,888,404 | 6/1975 | Ramspeck et al. | 227/8 |
| 4,378,084 | 3/1983 | Scala | 227/8 |
| 4,405,071 | 9/1983 | Austin | 227/8 X |
| 4,550,643 | 11/1985 | Schwartzenberger | 227/8 X |
| 4,629,106 | 12/1986 | Howard et al. | 227/8 |

*Primary Examiner*—Paul A. Bell

*Attorney, Agent, or Firm*—Frost & Jacobs

[57] ABSTRACT

A valve arrangement for a fastener driving tool of the type having a cylinder and piston/driver assembly for driving a fastener, a main valve which, when actuated, opens the cylinder to air under pressure causing the piston/driver assembly to drive a fastener, a remote valve which, when actuated, causes the main valve to open, and a trigger actuated valve together with a workpiece responsive safety actuated valve which, when both are actuated, actuate the remote valve, the valve arrangement being such that the safety actuated valve must be actuated before the trigger actuated valve in order for the remote valve to the actuated. The trigger actuated valve has a trigger-operated stem slidably mounted within a valve body. The body defines a chamber in which one end of the remote valve stem is slidingly and sealingly engaged. Air under pressure within the chamber maintains the remote valve stem in an unactuated position. A passage in the tool body connects the trigger actuated valve to the safety actuated valve. The chamber is connected to said passage when the trigger actuated valve is open. The passage is connected to atmosphere when the safety actuated valve is open. One of the trigger actuated valve and the safety actuated valve is an on-off valve and the other is a pressure controlled valve. The pressure controlled valve precludes connection of the chamber to atmosphere via passage to shift the remote valve stem to its actuated position unless the safety actuated valve is opened prior to the opening of the trigger actuated valve.

13 Claims, 12 Drawing Sheets

RESTRICTIVE TRIGGER ACTUATED VALVE ARRANGEMENT FOR A FASTENER DRIVING TOOL

TECHNICAL FIELD

The invention relates to a pneumatic fastener driving tool, and more particularly to a trigger actuated valve and safety actuated valve arrangement providing the tool with a restrictive trigger.

BACKGROUND ART

While the teachings of the present invention may be applicable to other similar type pneumatic fastener driving tools, it is particularly directed to and will be described in terms of its application to a pneumatic fastener driving tool of the type illustrated in U.S. Pat. No. 4,669,648. The structure and mode of operation of this fastener driving tool will be described in detail hereinafter.

In general, the fastener driving tool of the type to which the present invention is directed is characterized by a cylinder containing a piston/driver assembly. Actuation of the piston/driver assembly is controlled by a main valve at the upper end of the cylinder. The main valve, itself, is controlled by a remote valve. Thus, when the remote valve is shifted from its normal to its actuated position, the main valve will shift from its closed to its open position, allowing air under pressure to enter the cylinder and actuate the piston/driver assembly to drive a fastener into a workpiece.

The remote valve, itself, is controlled by the combination of a trigger actuated valve and a safety actuated valve. The trigger actuated valve is operated by a manual trigger. The safety actuated valve is operated by a workpiece responsive trip or safety, as is known in the art.

The pneumatic fastener driving tool to which the present invention is directed is characterized by the fact that both the trigger actuated valve and the safety actuated valve are of the on-off type and both must be opened in order to shift the remote valve from its normal to its actuated position. However, it makes no difference which of the safety actuated valve and trigger actuated valve is opened first, so long as both of them are opened.

A problem arises from the fact that various safety codes require that pneumatic fastener driving tools have restrictive triggers, such that the workpiece responsive safety must be operated before the manual trigger. The present invention teaches trigger actuated valve/safety actuated valve arrangements which render the manual trigger of the tool a restrictive trigger, which operates the tool only if the workpiece responsive safety has been operated before the manual trigger. The invention is based upon the discovery that a fastener driving tool of the type to which the present invention is directed can be provided as a restrictive trigger tool, upon modification of the trigger actuated valve and replacement of the prior art safety actuated on-off valve with a safety actuated pressure controlled valve of the present invention. Alternatively, a restrictive trigger tool can be achieved with the original safety actuated on-off valve and replacement of the on-off trigger actuated valve with a pressure controlled trigger actuated valve. According to the present invention, such pneumatic fastener driving tools can be manufactured as restrictive trigger tools, and existing tools can be easily modified to have the restrictive trigger mode of operation.

DISCLOSURE OF THE INVENTION

According to the invention there is provided a valve arrangement for a fastener driving tool of the type having a cylinder and piston/driver assembly for driving a fastener, a main valve which, when actuated, opens the cylinder to air under pressure causing the piston/driver assembly to drive a fastener, a remote valve which, when actuated, causes the main valve to open, and a trigger actuated valve and a workpiece responsive safety actuated valve which, when both are actuated, actuate the remote valve, the valve arrangement being such that the safety actuated valve must be actuated before the trigger actuated valve in order to actuate the remote valve.

In one embodiment, the trigger actuated valve is an on-off valve having a stem which is operated by a manual trigger. The trigger actuated valve body defines a chamber in which one end of the remote valve stem is slidingly and sealingly engaged. Air under pressure within this chamber maintains the remote valve stem in an unactuated position. When the valve stem of the trigger actuated valve is shifted to its open position by the manual trigger, the above noted chamber is connected by passage means to the safety actuated valve.

The safety actuated valve is a pressure controlled valve having a plunger actuable by the workpiece responsive safety. This plunger is connected to the stem of the safety actuated valve by a compression spring. When the plunger is operated by the workpiece responsive safety, the compression spring is strong enough to open the stem of the safety actuated valve to release air under pressure from the chamber of the trigger actuated valve to atmosphere and to thereby actuate the remote valve, only if the plunger is actuated before the manual trigger.

In a second embodiment of the present invention, the original on-off type safety actuated valve remains unchanged. The safety actuated valve has a stem which cooperates with a valve seat. Its valve stem is normally maintained in a closed position by a compression spring. When the guide body of the tool is pressed against a workpiece, the workpiece responsive safety is shifted upwardly, and its actuator shifts the stem of the safety actuated valve from its closed position to its open position.

In this second embodiment of the invention, the original on-off type trigger actuated valve is replaced by a pressure controlled trigger actuated valve of the present invention. This last mentioned valve comprises a valve housing having a valve seat. A valve stem is shiftably mounted in the valve housing and has a head portion adapted to cooperate with the valve seat. A valve cage is slidably mounted within the housing and surrounds and is slidable with respect to the valve stem. When the tool is connected to a source of air under pressure, and the pressure controlled trigger actuated valve is in its normal unactuated condition, the valve stem head abuts the valve seat, closing the valve and the valve cage is in its lowermost position with its upper end making a seal with the valve housing below the valve seat. The valve stem and the valve cage are interconnected by a compression spring. When the valve stem is shifted to its open position by the tool trigger, the remote valve will be actuated and the main valve will open to drive a fastener, only if the safety actuated valve is actuated by the workpiece responsive safety before the tool trigger is actuated, so that the valve cage is in its uppermost position and out of sealing engagement with the valve housing, allowing clear passage for the pressurized air beneath the remote valve to be vented through the trigger actuated valve and the safety actuated valve to atmosphere.

BRIEF DESCRIPTION OF THE DRAWINGS

FIG. 23 also illustrates the parts of the trigger actuated valve in the positions they occupy when the safety actuated valve is actuated, and the manual trigger is unactuated.

DETAILED DESCRIPTION OF THE INVENTION

In order to fully understand the trigger actuated valve/safety actuated valve system of the present invention, it is necessary to comprehend the nature and operation of the prior art fastener driving tool to which the present invention is directed. To this end, FIGS. 1–9 illustrate an exemplary prior art nail driving tool of the type illustrated in U.S. Pat. No. 4,669,648.

Figure 1:
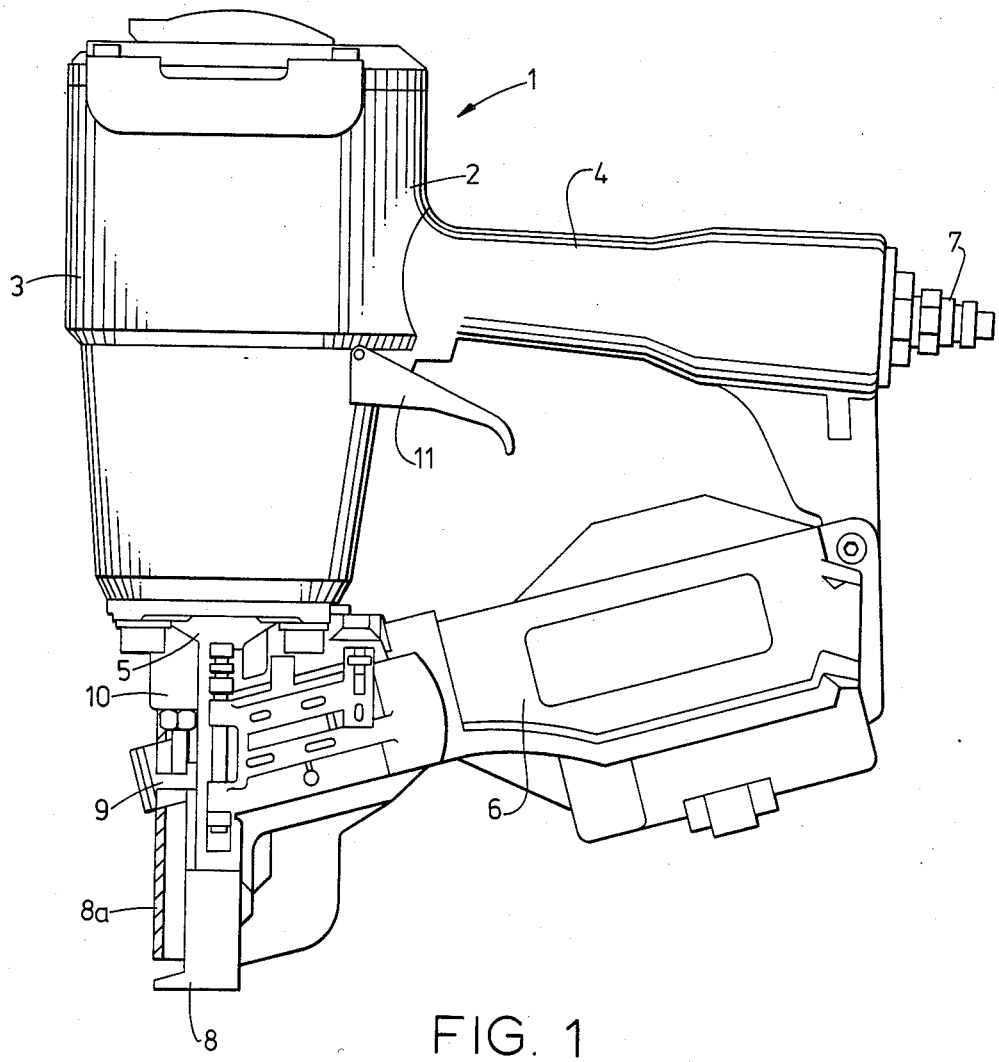
FIG. 1 PRIOR ART
FIG. 1 is an elevational view, partly in cross section, of the prior art fastener driving tool to which the present invention is directed.

Turning first to FIG. 1, the prior art tool is generally indicated at 1. The tool 1 has a body 2 comprising a main body portion 3 and a handle portion 4. The main body portion 3 contains a cylinder, a piston/driver assembly within the cylinder, a main valve for operating the piston/driver assembly at the top of the cylinder, and a remote valve for operating the main valve. The cylinder, piston/driver assembly, main valve and remote valve are not shown in FIG. 1, but will be described in detail hereinafter with respect to FIG. 2.

Affixed to the lower end of the main body portion 3 there is a guide body 5. The guide body 5 defines a driver track for the driver of the piston/driver assembly. Affixed at its forward end to the guide body and at its rearward end to the handle portion 4 there is a magazine 6 containing a coiled strip of fasteners such as roofing nails or the like. The magazine 6 has a fastener advancing mechanism (not shown) which locates the forwardmost fastener of the strip in the drive track after each actuation of the tool 1. The nature of magazine 6 and its fastener advancing mechanism does not constitute a part of the present invention.

The tool 1 is provided with a fitting 7 by which it can be connected to a flexible conduit or hose, in turn connected to a source of air under pressure. Slidably mounted for vertical movement on guide body 5 there is a workpiece responsive safety 8, constituting a safety device as is known in the art. The workpiece responsive safety is biased to its lowermost extended position as shown in FIG. 1. When the lower end of guide body 5 is pressed against a workpiece, the workpiece responsive safety 8 will shift upwardly as viewed in FIG. 1. The workpiece responsive safety 8 has an actuator 9 which operates the plunger of a safety actuated valve 10 when the guide body 5 is pressed against a workpiece. A shield **8*a* may be provided about the guide body 5 and workpiece responsive safety 8. The tool 1 is also provided with a manual trigger 11 which operates a trigger actuated valve (not shown). As indicated above, and as will be apparent hereinafter, the tool will drive a nail into a workpiece when both the safety actuated valve 10** and the trigger actuated valve are actuated in any order thereof.

Figure 2:
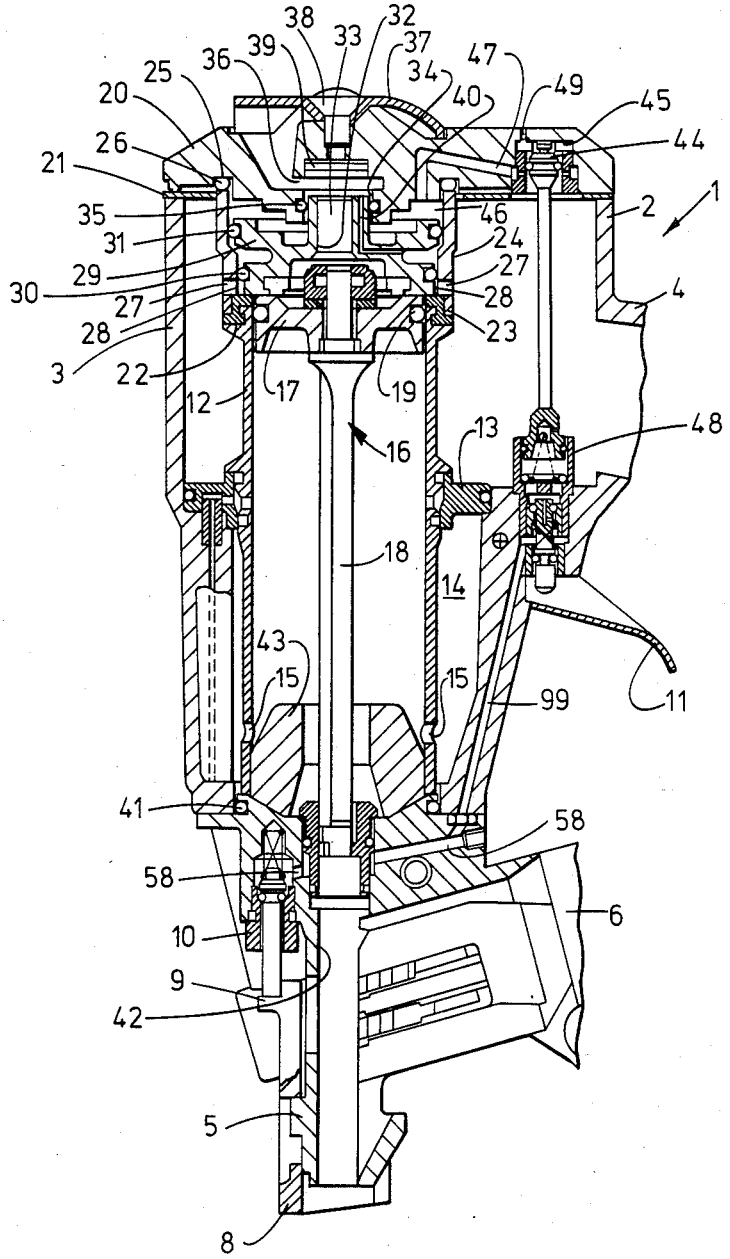
FIG. 2 PRIOR ART
FIG. 2 is a fragmentary cross sectional view of the prior art tool of FIG. 1.

Reference is now made to FIG. 2 wherein the tool 1 is shown in greater detail. As indicated above, the main body portion 3 contains a cylinder 12. Sealingly engaged on the cylinder 12 there is a sleeve 13 which also sealingly engages the inside surface of the main body portion 3. The sleeve 12, the main body portion 13 therebelow and the lower portion of cylinder 12 define an annular return air chamber 14. The lower end of cylinder 12 has an annular array of perforations 15 formed therein communicating with the return air chamber 14.

Mounted within cylinder 12 is the piston/driver assembly 16. The piston/driver assembly 16 comprises piston 17 and driver 18 affixed to piston 17. The piston 17 carries an O-ring 19 which sealingly engages the inner surface of cylinder 12.

The upper end of main body portion 3 is closed by a cap 20, provided with an appropriate seal or gasket 21. The upper end of cylinder 12 mounts an annular seal 22. The seal 22 is further held in place by a spacer ring 23. The spacer ring 23 is surmounted by a cylindrical sleeve 24. The upper end of sleeve 24 is received within an annular groove 25 formed in cap 20 and containing an O-ring 26. The lower end of sleeve 24 is provided with a plurality of evenly spaced downwardly depending legs 27 which bear against spacer ringer 23. The spaces between legs 27 constitute passages 28 leading to the main valve.

The main valve is shown at 29, shiftable vertically within sleeve 24. The main valve 29 comprises an annular member carrying O-rings 30 and 31 sealingly engaging the interior surface of sleeve 24. The main valve 29 has an upstanding cylindrical portion 32 having a central bore 33 formed therein. The cylindrical portion 32 extends through an opening 34 in cap 20 and is sealingly engaged by an O-ring 35 mounted in the opening 34. The opening 34 connects with a passage 36 formed in the cap and leading to atmosphere. The cap 20 is provided with a deflector 37 affixed to the cap by a bolt 38. The deflector 37 cooperates with passage 36 to direct air under pressure passing therethrough away from the tool operator. The cap 20 also mounts a seal 39 directly above the cylindrical portion 32 of main valve 29. The main valve 29 is completed by a passage 40 formed therein leading from the space between O-rings 30 and 31 to the cap passage 36.

The guide body 5 is affixed to the lower end of main body portion 3 by machine screws or the like (not shown). The juncture of guide body 5 and main body portion 3 is sealed by O-ring 41. The guide body defines a drive track 42 and supports, at the lower end of cylinder 12, a resilient bumper 43 which absorbs the remaining energy of the piston/driver assembly at the bottom end of its drive stroke.

The main valve 29 is controlled by a remoted valve 44. The remote valve body is located in a bore 45 in cap 20. The remote valve 44 is connected to that volume 46 defined by cap 20, the upper surfaces of main valve 29 and sleeve 24 by a passage 47 formed in the cap. The remote valve 44 is operated by safety actuated valve 10, operated by workpiece responsive safety 8 and trigger actuated valve 48, operated by manual trigger 11. The safety actuated valve 10 will be described in detail with respect to FIG. 3. The remote valve 44 and trigger actuated valve 48 will be described with respect to FIG. 4.

At this stage, the tool 1 has been sufficiently described to set forth the nature of the operation of main valve 29. In FIG. 2, all of the elements of the tool are shown in their normal, unactuated condition. In this condition, the main valve 29 is in its lowermost position and bears against the annular seal 22 mounted on the upper end of cylinder 12. The volume between the upper surface of piston 17 and the lower surface of main valve 29 is vented to atmosphere by means of main valve bore 33 and cap passage 36. Similarly, the volume defined by the main valve 29 and the sleeve 24, between main valve O-rings 30 and 31, is vented to atmosphere by means of passage 40 in the main valve and passage 36 of cap 20.

Remote valve 44 is shown in its normal uppermost position wherein, as will be more clearly shown hereafter, the passage 47 in cap 20 is connected to the air under pressure within the main body portion 3. Thus, volume 46 between the main valve and the cap is subject this same air under pressure. The O-ring 30 of main valve 29 is also subjected to the same air under pressure via passages 28. However, since the area of O-ring 30 is far less than the area of the upper surface of the main valve 29, the air under pressure in volume 46 will maintain the main valve 29 seated against seal 22, thereby closing the upper end of cylinder 12.

When remote valve 44 is actuated through the agency of safety actuated valve 10 and trigger actuated valve 48, as will be described in detail hereinafter, the stem of remote valve 44 shifts downwardly and this connects the volume 46 between cap 20 and main valve 29 to atmosphere via passage 47, the body of remote valve 44 and passage 49. When the upper surface of main valve 29 is subjected to atmospheric pressure, and its lower O-ring 30 is subjected to the air under pressure within main body portion 3, the air under pressure via passages 28 will cause the main valve 29 to shift upwardly until its upstanding cylindrical portion 32 abuts seal 39. This last mentioned abutment effectively closes passage 33 and passage 40. As soon as the main valve 29 lifts from cylinder seal 22, the piston/driver assembly 16 is subjected to the air under pressure and is forced downwardly to drive a fastener or nail into the workpiece.

When remote valve 44 is returned to its upper or normal position, reconnecting passage 47 to the air under pressure within main body portion 3, the main valve 29 will return to its closed position. During its work stroke, air trapped beneath piston/driver assembly 16 is compressed and driven into return air chamber 14. As son as main valve 29 has returned to its closed position and the volume between the upper surface of piston 17 and the main valve is again reconnected to atmosphere via passage 33 in the main valve 29 and passage 36 in cap 20, the air under pressure in return air chamber 14 will shift the piston/driver assembly 16 to its normal upper position shown in FIG. 2.

Figure 3:
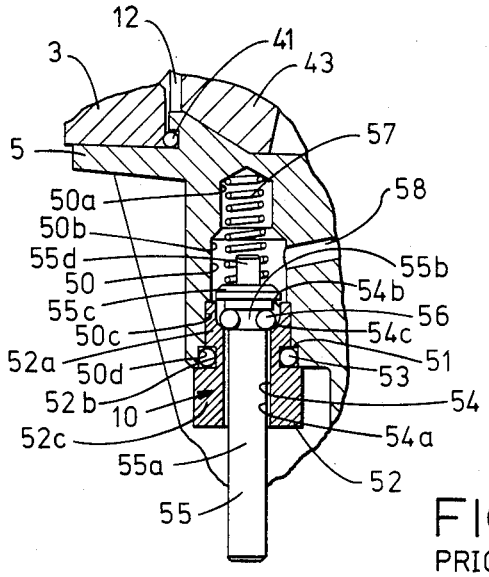
FIG. 3 PRIOR ART
FIG. 3 is an enlarged, fragmentary, cross sectional view of the safety actuated valve of the prior art tool of FIG. 1.

Reference is now made to FIG. 3 wherein the safety actuated valve 10 is illustrated. The guide body 5 has a bore 50 formed therein. The bore 50 has an uppermost portion 50*a*. The uppermost portion is followed by an intermediate portion 50*b* of slightly larger diameter. The portion 50*b* is followed by an internally threaded portion 50*c*, which, in turn, is followed by a portion 50*d* of slightly larger diameter, forming a shoulder 51.

A valve body 52 is provided. Valve body 52 has an upper threaded portion 52*a* adapted to be threadedly engaged in the internally threaded portion 50*c* of bore 50. Valve body portion 52*a* is followed by an annular groove 52*b*, receiving an O-ring 53. O-ring 53 cooperates with bore portion 50*d* and shoulder 51 to form a seal between valve body 52 and guide body 5. The bottom-most portion 52*c* of valve body 52 may have a hexagonal periphery so that it can be easily engaged by a wrench or other appropriate tool.

Valve body 52 has an axial bore 54 with a first portion 54*a*, surmounted by a second portion 54*b* of larger diameter. A shoulder or seat 54*c* is formed between the portions 54*a* and 54*b*.

Safety actuated valve 10 is provided with a valve stem 55. Valve stem 55 has a plunger-like cylindrical portion 55*a* which is axially shiftable in valve body bore portion 54*a*. At its upper end, valve stem 55 is provided with an annular groove 55*b*, a cap-like portion 55*c* and an upstanding short portion 55*d* of lesser diameter. The annular groove 55*b* carries an O-ring 56 adapted to cooperate with valve body seat 54*c*.

Safety actuated valve 10 is completed by a compression spring 57. The upper end of compression spring 57 abuts the uppermost end of guide body bore portion 50*a*. The lower end of compression spring 57 surrounds the valve stem cylindrical extension 55*d* and abuts the head-like portion 55*c*. It will be apparent that spring 57 serves to bias the valve stem to its closed position wherein O-ring 56 seals against valve body seat 54*c*. It will further be apparent from FIG. 3 that if the valve stem 55 is shifted upwardly against the action of spring 57 to the extent that O-ring 56 disengages from valve seat 54*c*, then those portions of bore 50 above the valve body 52 are connected to atmosphere by way of the clearance between valve stem 55 and valve body bore portion 54*a*. Finally, it will be noted that a passage 58 formed in guide body 5 communicates with the portion 50*b* of guide body bore 50. The purpose of passage 58 will be apparent hereinafter.

Figure 4:
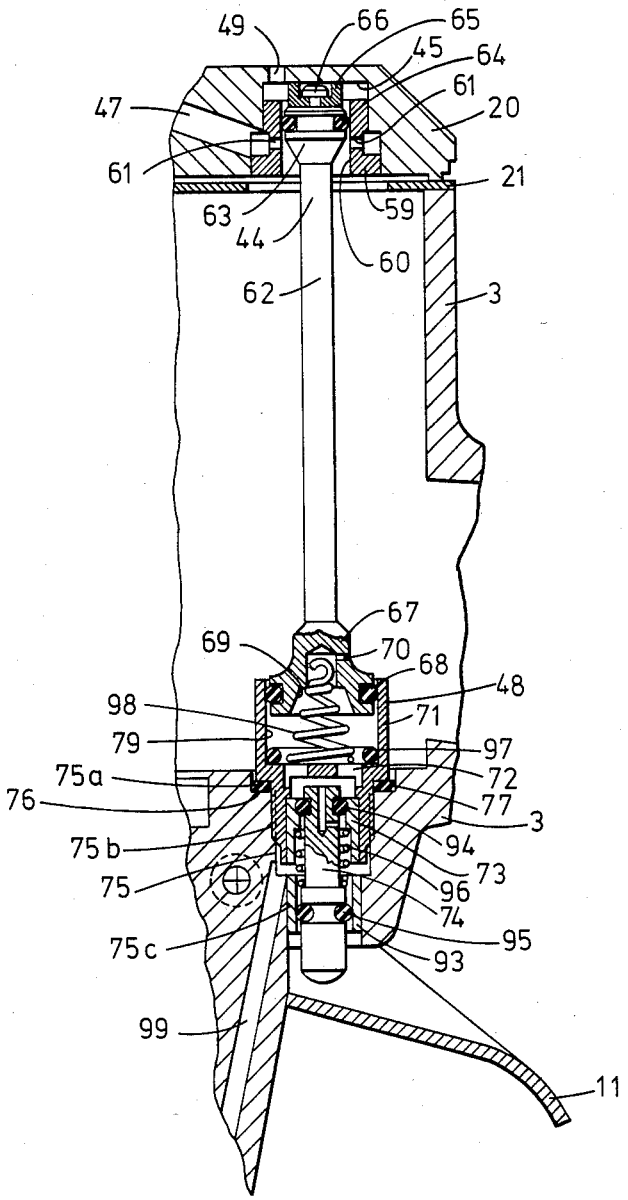
FIG. 4 PRIOR ART
FIG. 4 is an enlarged, fragmentary, cross sectional view of the trigger actuated valve and the remote valve of the prior art tool of FIG. 1.

Reference is now made to FIG. 4 wherein the remote valve 44 and trigger actuated valve 48 are clearly shown. The remote valve 44 comprises a housing 59 mounted in the bore 45 of cap 20. Housing 59 has an axial bore 60 and an annular array of perforations 61 which extend from the housing bore 60 to the cap bore 45, to which cap passage 47 is connected.

The valve stem 62 of remote valve 44 terminates at its upper end in an enlarged head 63 carrying an O-ring 64 sealingly engaging the inside surface of housing bore 60. The uppermost end of valve stem head 63 carries a sealing element 65 affixed thereto by fastener means 66. The lower end of stem 62 terminates in an enlarged member 67 carrying an O-ring 68 and having an axial bore 69. A small passage 70 extends from axial bore 69 to the exterior of the enlarged member 67.

In FIG. 4, the remote valve is shown in its normal state. In this state, it will be noted that O-ring 64 of the valve stem head 63 is located above the annular array of passages 61 so that cap passage 47 is connected thereby directly to air under pressure within the main body portion 3. Under these circumstances, the air under pressure in passage 47 results in air under pressure in volume 46 (see FIG. 2) above main valve 29, assuring that main valve 29 will be in its normal closed position. At the same time, the combination of O-ring 64 and seal 65 effectively closes passage 49 which leads to atmosphere.

When the remote valve 44 is actuated, as will be described hereinafter, the stem 62 will shift downwardly (as viewed in FIG. 4) until O-ring 64 is located beneath the annular array of passages 61. This effectively seals cap passage 47 from the air under pressure within the main body portion 3. At the same time, this position of the remote valve stem 62 effectively opens cap passage 47 and the annular array of perforations 61 to atmosphere, via cap passage 49. Under these circumstances, the volume 46 above main valve 29 will be connected to atmosphere, and air under pressure acting upon the main valve 29 through passages 28 will cause the main valve to shift upwardly, resulting in actuation of the tool and the driving of a fastener.

The safety actuated valve 10 and remote valve 44 having been described, the only remaining portion of the mechanism which actuates main valve 29 is trigger actuated valve 48, operated by manual trigger 11. As can be clearly seen in FIG. 4, the trigger actuated valve 48 comprises a body 71, a spring seat 72, a valve seat 73, and a valve stem 74. The trigger valve assembly 48 is located in a bore 75 formed in the main body portion 3 of fastener driving tool 1. The bore 75 has an uppermost portion 75*a* followed by an intermediate portion 75*b* which is internally threaded and of lesser diameter than bore portion 75*a*. Bore portion 75*b*, in turn, is followed by bore portion 75*c* of yet smaller diameter. The shoulder 76 formed between bore portions 75*a* and 75*b* supports an washer 77 which forms a seal between bore 75 and the trigger valve housing 71.

Figure 5:
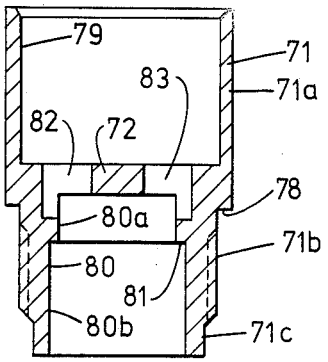
FIG. 5 PRIOR ART
FIG. 5 is a cross sectional view of the housing of the prior art trigger actuated valve of FIG. 4.

The trigger valve housing 71 is most clearly shown in FIG. 5. It comprises a cylindrical member having an upper portion 71*a*, followed by an intermediate portion 71*b* of lesser diameter and a lower portion 71*c* of even smaller diameter. The intermediate portion 71*b* is threaded so that it can be threadedly engaged in the portion 75*b* of main body bore 75. The shoulder 78 is adapted to engage washer 77, as shown in FIG. 4, to form the above-noted seal between the trigger valve housing 71 and bore 75.

Valve housing 71 has an upper axial bore 79 and a lower axial bore 80, as viewed in FIG. 5. Lower axial bore 80 has an upper portion 80*a*, followed by a portion 80*b* of greater diameter. It will be noted that an annular shoulder 81 is formed between bore portions 80*a* and 80*b*. The purpose of shoulder 81 will become apparent hereinafter.

Figure 6:
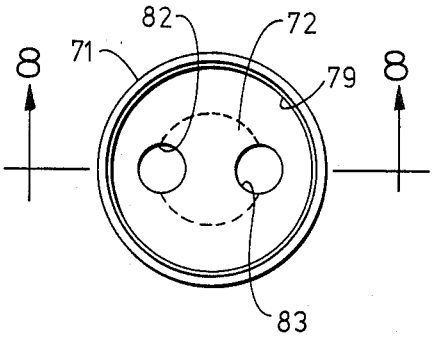
FIG. 6 PRIOR ART
FIG. 6 is a plan view of the housing of the prior art trigger actuated valve of FIG. 4.

As is shown in FIGS. 5 and 6, the valve housing bores 79 and 80 form between them a transverse web which constitutes spring seat 72. Spring seat 72 has a pair of holes 82 and 83 formed therein, which join valve housing bores 9 and 80.

Figure 7:
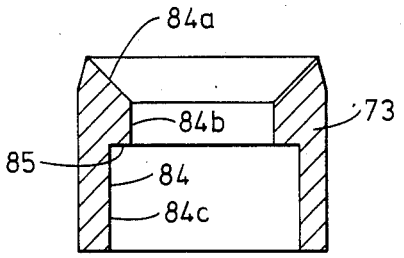
FIG. 7 PRIOR ART
FIG. 7 is a cross sectional view of the valve seat of the prior art actuated valve of FIG. 4.

FIG. 7 illustrates valve seat 73. Valve seat 73 is a cylindrical member having an outside diameter of such size with respect to the inside diameter of housing bore portion 80*b* as to be receivable therein with a force fit. As is apparent from FIG. 4, when the valve seat 73 is appropriately located within valve housing bore portion 80*b*, its upper end will engage valve housing shoulder 81.

Valve seat 73 has a central bore 84 therethrough. The central bore 84 is made up of three portions. The topmost portion 84*a* slopes downwardly and inwardly (as viewed in FIG. 7) and constitutes the actual valve seat. The portion 84*a* is followed by a portion 84*b*. This portion, in turn, is followed by a portion 84*c*. An annular shoulder 85 is formed between bore portions 84*b* and 84*c*. The purpose of shoulder 85 will be apparent hereinafter.

Figure 8:
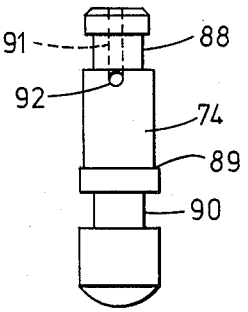
FIG. 8 PRIOR ART
FIG. 8 is an elevational view of the stem of the prior art trigger actuated valve of FIG. 4.

The final major element of the trigger valve 48 is valve stem 74, illustrated in FIGS. 4 and 8. Valve stem 74 has an annular groove 88 near its upper end (as viewed in FIG. 8). The lower portion of valve stem 74 is somewhat enlarged in diameter, forming an annular shoulder 89. The enlarged lower portion of valve stem 74 has an annular groove 90.

At its upper end, valve stem 74 is provided with an axial bleed hole 91. The bleed hole 91 connects with a transverse bleed hole 92. The holes 91 and 92 form a bleed passage 91–92.

Returning to FIG. 4, it will be noted that a ring member 93 is mounted within the bore portion 75c of main housing 3 with a forced or friction fit. When valve stem 74 is mounted in place, its annular groove 88 supports an O-ring 94 which cooperates with valve seat surface 84a (see FIG. 7). The annular groove 90 of valve stem 74 carries an O-ring 95 which sealingly engages the inside surface of ring member 93. The valve stem 74 is urged to its closed position, as shown in FIG. 4, by a compression spring 96. The upper end of compression spring 96 seats against the annular shoulder 85 of valve seat 73. The lower end of compression spring 96 abuts the shoulder 89 of valve stem 74. It will be apparent from FIG. 4 that when manual trigger 11 is squeezed, it will engage the free end of valve stem 74, causing the stem to shift upwardly against the action of compression spring 96 so as to lift O-ring 94 from the valve seat surface 84a, thereby opening trigger actuated valve 48.

It will be further noted from FIG. 4 that the lower enlarged member 67 of valve stem 62 of remote valve 44 is received with the bore portion 79 of valve housing 71. The O-ring 68 of the enlarged member 67 sealingly engages the inside surface of valve housing bore portion 79. An O-ring 97 rests on the spring seat 72 of the valve housing 71 and serves as a bumper for the enlarged member 67 of remote valve stem 62. Furthermore, a conical compression spring 98 is provided within the bore portion 79 of valve housing 71. The compression spring 98 extends upwardly into the perforation 69 of the enlarged member 67 of the remote valve stem 62 and seats therein. The lower end of compression spring 98 abuts spring seat 72. Thus, compression spring 98 constantly urges remote valve 44 to its normal, unactuated position shown in FIGS. 2 and 4.

FIG. 4 illustrates a passage 99 extending downwardly in main body portion 3 from bore 75, at a point adjacent the juncture of bore portions 75b and 75c. As will be apparent from FIG. 2, the passage 99 communicates with passage 58. Therefore, safety actuated valve 10 and trigger actuated valve 48 are interconnected.

All of the parts necessary to actuate main valve 29 having been described, the operation of these parts can now be set forth. Reference is made to FIGS. 2, 3, and 4. In these figures, all of the parts are shown in their normal, unactuated positions.

It will be remembered that so long as remote valve 44 remains in its normal position, the volume 46 above main valve 29 is connected to air under pressure within the main body portion 3 by passage 47 and the annular array of perforations 61 in the remote valve housing 59. In order to open main valve 29 to actuate the piston/-driver assembly 16 to drive a fastener, it is necessary to connect the volume 46 above main valve 29 to atmosphere. This is accomplished when remote valve 44 shifts downwardly to its actuated position, so that its O-ring 64 is located below the annular array of perforations 61. When this happens, the volume 46 above main cylinder 29 is connected by passage 47, the annular array of perforations 61 and bore 49 to atmosphere.

As indicated above, the remote valve 44 is shifted to its actuated position by operation of safety actuated valve 10 and trigger actuated valve 48. Both the safety actuated valve 10 and trigger actuated valve 48 must be actuated, but it makes no difference which of the two is actuated first. When all of the safety actuated, trigger actuated and remote valves are in their normal position, the remote valve 44 is held in its normal position by pressurized air from the tool main body portion 3 acting upon the enlarged head portion 63 at the upper end of remote valve stem 62. This action is reinforced by the action of compression spring 98. In addition, pressurized air from within the tool main body portion 3 also passes through the small perforation 70 in the enlarged member 67 of the remote valve stem 62 and acts upon the bottom surface of this enlarged member. Thus, pressurized air acting upon member 63 and the underside of enlarged member 67, together with compression spring 98 is enough to counteract pressurized air acting upon the upper surface of enlarged member 67. The pressurized air which passes through small perforation 70 in enlarged member 67 also passes through the perforations 82 and 83 (see FIGS. 5 and 6) in the spring seat 72 and serves to assist compression spring 96 in maintaining the trigger actuated valve stem 74 in its normal position. Finally, this same pressurized air from the tool main body portion also passes through bleed passage 91–92 of valve stem (see FIG. 9) to pressurize the passages 99 and 58. This, in turn, tends to reinforce the action of compression spring 57 which maintains the stem 55 of safety actuated valve 10 in its closed position.

Considering an instance where the tool operator first places the nose of the tool against the workpiece, shifting workpiece responsive safety 8 upwardly (as viewed in FIG. 1). The workpiece responsive safety actuator 9 will engage the stem 55 of safety actuated valve 10, shifting it upwardly against the action of compression spring 57 and lifting O-ring 56 from valve seat 54c. Thus, safety actuated valve 10 is in its open position and passages 99 and 58 are thereby connected to atmosphere. Nevertheless, remote valve 44 will not shift downwardly to its actuated position because the volume of pressurized air passing through bleed passage 91–92 is not sufficient to remove pressure acting on the underside of enlarged member 67.

With the safety actuated valve open, the operator then opens the trigger actuated valve 48 by squeezing manual trigger 11, shifting the valve stem 74 upwardly (as viewed in FIG. 4) so that O-ring 94 will be lifted from the valve seat surface 84a (see FIG. 7). Now, the volume beneath the enlarged member 67 of remote valve 44 is connected directly to atmosphere through the open trigger actuated valve 48, passages 99 and 58, and the open safety actuated valve 10. At this point, the action of pressurized air within the tool main body portion 3, operating on the upper surface of the enlarged member 67 of remote valve 44 is enough to overcome the action of the pressurized air against the head 63 of the remote valve stem 62 and the action of compression spring 98, resulting in shifting of the stem 62 of remote valve 44 downwardly (as viewed in FIG. 4) which, as explained above, will result in the opening of main valve 29 and the driving of a fastener.

In an instance where the operator of the tool operates the trigger actuated valve first, causing valve stem 74 to shift to its open position, the remote valve 44 will not shift to its actuated position since the pressurized air free to pass through the trigger actuated valve is blocked by the safety actuated valve 10. However, with the trigger actuated valve open, the moment the operator shoves the nose of the tool onto the workpiece, causing the actuator 9 of the workpiece responsive safety 8 to shift the stem 55 of safety actuated valve 10 to its open position, the remote valve 44 will shift to its actuated position and a fastener will be driven.

From the description thus far, it will be apparent that in order to drive a fastener, both trigger actuated valve 48 and safety actuated valve 10 must be shifted to their open positions, but it does not make any difference which is so shifted first. Both the trigger actuated valve and the safety actuated valve function as on-off valves.

It will also be apparent from the above description that should the operator shift the trigger actuated valve 48 to its open or actuated position and hold it there, a fastener will be fired each time the safety actuated valve 10 is shifted to its open position by the actuator 9 of the workpiece responsive safety 8. Similarly, should the operator rest the nose of the tool on the workpiece so that the actuator 9 of the workpiece responsive safety 8 opens safety actuated valve 10, and should the operator maintain the nose portion of the tool on the workpiece, dragging it therealong, a fastener will be driven everytime the trigger actuated valve is opened by actuation of manual trigger 11.

A fastener driving tool of the type just described is known in the art as a "bottom-fire/trigger-fire" tool. The tool is capable of "bottom-firing" by means of the workpiece responsive safety 8 when the trigger 11 is maintained in its squeezed position. Similarly, the tool is capable of "trigger-firing" when the workpiece responsive safety is actuated before the trigger 11, or when the workpiece responsive safety 8 is maintained in an actuated position, whereupon a fastener will be driven upon each operation of the manual trigger.

As indicated above, various safety codes require that fastener driving tools of the type just described be provided with what is known in the art as "restrictive triggers". The phrase "restrictive trigger" refers to a tool wherein the workpiece responsive safety 8 must be operated before the trigger 11 is actuated, in order to drive a fastener. The bottom-fire/trigger-fire prior art tool just described, is not capable of acting as a restrictive trigger tool. However, a tool of the type just described can be converted to a restrictive trigger tool if the teachings of the present invention are followed, which teachings will now be set forth.

Figure 9:
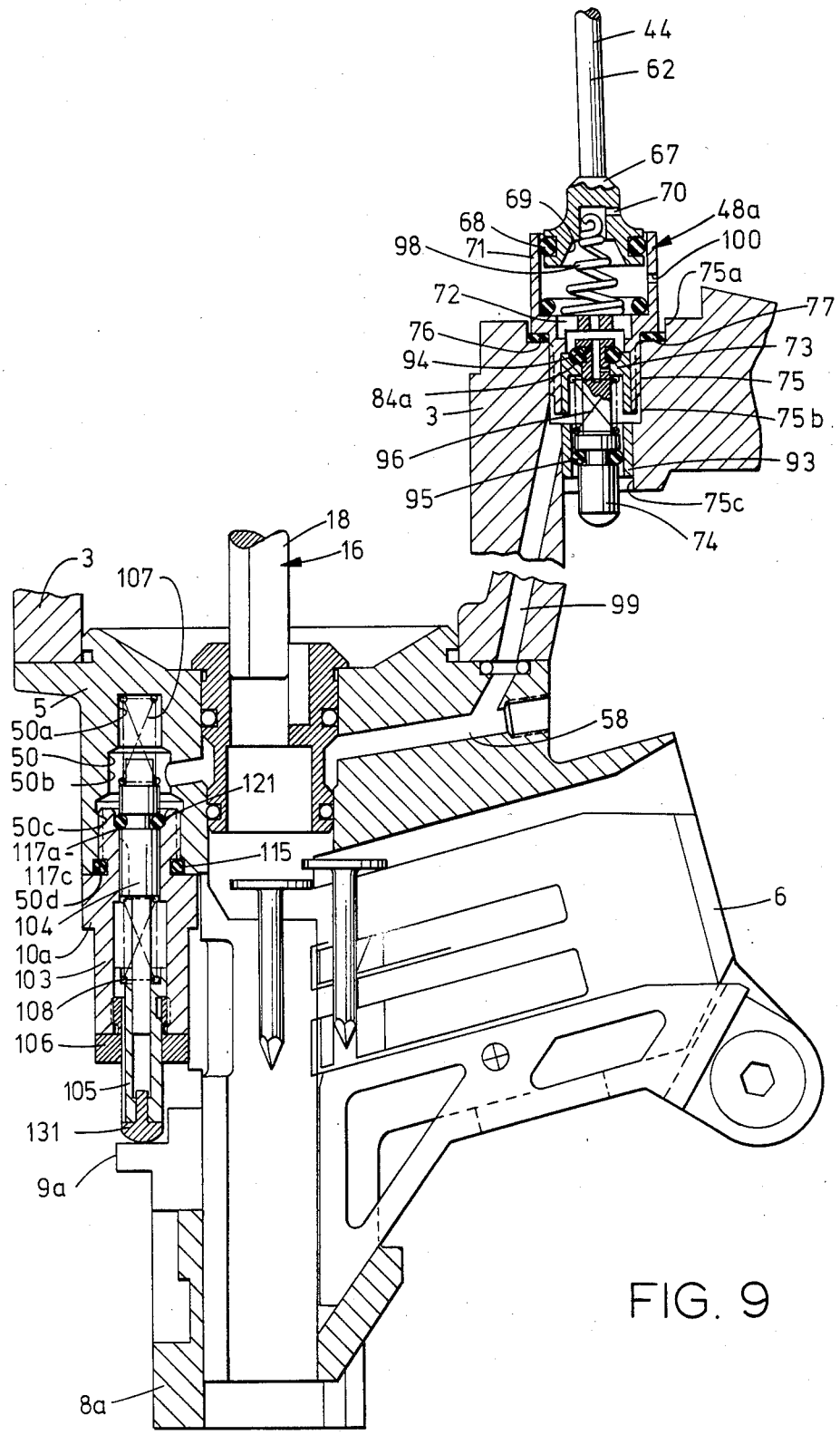
FIG. 9 is a fragmentary cross sectional view of a fastener driving tool, similar to that of FIGS. 1 and 2, and the trigger actuated valve and safety actuated valve of the present invention.

In a first embodiment of the present invention, in order to convert the prior art tool just described to a restrictive trigger tool, the trigger actuated valve is modified and the safety actuated valve is replaced by a different safety actuated valve. All other parts of the tool may remain unchanged, including the main valve 29 and the remote valve 44. The present invention is illustrated in FIG. 9. Since only the trigger actuated valve and the safety actuated valve need be modified, like parts have been given like index numerals. In FIG. 9, the trigger actuated valve is generally indicated by index numeral **48*a*. The safety actuated valve is generally indicated by index numeral 10*a***.

Turning first to the modified trigger actuated valve **48*a*, this valve is made up of a housing 71, a spring seat 72, a valve seat 73 and a valve stem 74**.

Figure 10:
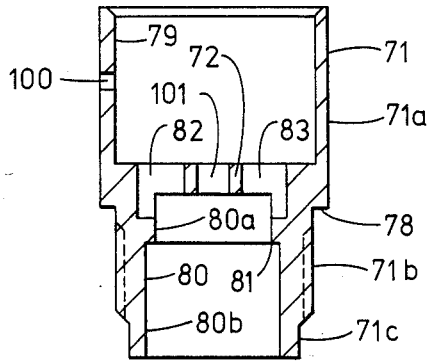
FIG. 10 is a cross sectional view of the valve housing of the trigger actuated valve of FIG. 9.

As is shown in FIG. 10, the valve housing is substantially identical to the valve housing of FIG. 5 and like parts have been given like index numerals. The valve housing of FIG. 10 differs from that of FIG. 5 only in that an additional bleed hole is formed in the upper portion of valve housing 71, as at 100.

Figure 11:
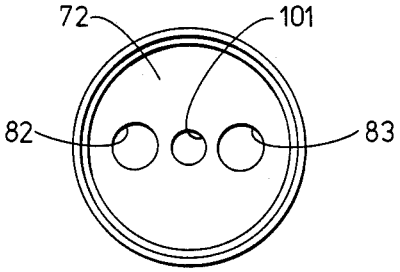
FIG. 11 is a plan view of the valve housing of the trigger actuated valve of FIG. 9.

The spring seat 72 of modified trigger actuated valve **48*a* is substantially identical to spring seat 72 of FIGS. 5 and 6. This is shown in FIGS. 10 and 11. The only change in spring seat 72 of FIGS. 10 and 11 is the provision of an access hole 101**, the purpose of which will be apparent hereinafter.

The valve seat used in modified valve **48*a* is identical to valve seat 73 of FIG. 7, and FIG. 7 may be considered to be an illustration of the valve seat for trigger actuated valve 48 and the valve seat for the trigger actuated valve 48*a***.

Figure 12:
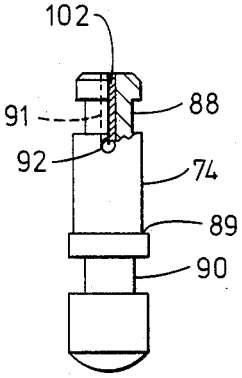
FIG. 12 is an elevational view, partly in cross section, of the valve stem of the trigger actuated valve of FIG. 9.

The valve stem 74 of modified trigger actuated valve **48*a* is shown in FIG. 12 and is identical to valve stem 74 of FIG. 8. Again, like parts have been given like index numerals. In this instance, however, a plug 102 is provided in bleed hole 91 to close off the bleed hole. As is shown in FIG. 9, the stem 74 carries an O-ring 94 in its upper annular groove, which O-ring is adapted to cooperate with the valve seat. The stem 74 also carries an O-ring 95 in its lower annular groove, which cooperates with ring 93, in the same manner described with respect to FIG. 4. As in the embodiment of FIG. 4, valve stem 74 is urged to its closed position by compression spring 96**.

From the above description, it will be apparent that trigger actuated valve **48*a* of FIG. 9 differs from trigger actuated valve 48 of FIG. 4 only in the provision of additional bleed hole 100, access hole 101 in spring seat 72, and plug 102 in bleed hole 91 (see FIG. 12). The description of trigger actuated valve 48*a* has been directed to the modification of an already existing valve. It will be understood that, in a preassembled valve, stem 74 is not readily removable because it is trapped between spring seat 72 and valve seat 73. Under these circumstances, opening 101 is drilled in spring seat 72 to permit access to bleed hole 91 for purposes of plugging it. In a situation where trigger actuated valve 48*a* is manufactured as described, rather than converted from a pre-existing trigger actuated valve 48, the valve stem could be manufactured without bleed holes 91 and 92. In such an instance, plug 102 would not be necessary. Similarly, access hole 101 in spring seat 72** would not be needed.

It will be understood that trigger actuated valve **48*a* of FIG. 9 is a simple on-off valve. The provision of additional bleed hole 100 is simply to assure the presence of sufficient air under pressure within the chamber defined by the upper portion of valve housing 71 and the lower end of the enlarged member 67 of remote valve 44, to assure that remote valve 44** is normally held in its unactuated position.

In the prior art embodiment of FIGS. 2 and 3, the safety actuated valve 10 is a simple on-off valve. In the embodiment of the present invention, illustrated in FIG. 9, this valve has been replaced by a pressure controlled valve, next to be described. The new safety actuated valve **10*a* is adapted to be mounted in the pre-existing bore 50 in guide body 5**.

The valve **10*a* comprises a valve housing 103, a valve stem 104, a plunger 105, a plunger retaining nut 106, an upper compression spring 107 and a lower compression spring 108**.

Figure 13:
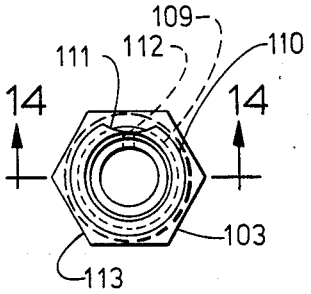
FIG. 13 is a top view of the housing of the safety actuated valve of FIG. 9.
Figure 14:
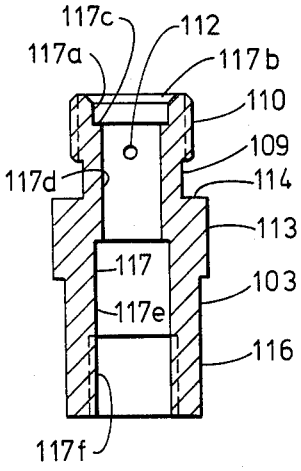
FIG. 14 is a cross sectional view taken along section line 14—14 FIG. 13.

Referring to FIGS. 13 and 14, the housing 103 has an upper cylindrical portion 109, externally threaded as at 110. As can best be determined from FIG. 13, the valve housing portion 109 has an arcuate notch 111 formed therein, constituting a shallow vertical channel. A perforation 112 is located in the side wall of valve housing portion 109, centered with respect to notch 111.

The upper portion 109 of valve housing 103 is followed by an intermediate portion 113 which may be hexagonal in peripheral configuration. The hexagonal configuration enables engagement by an appropriate wrench for installation and removal of valve housing 103 from guide body 5. As will be apparent in FIG. 9, the upper portion 109 of valve housing 103 is threadedly engaged in the threaded portion 50c of guide body bore 50. A shoulder 114 is formed at the juncture of valve housing portions 109 and 113. An O-ring 115 is mounted on the shoulder 114 and is received in the portion 50d of bore 50, to form a seal between the guide body 5 and valve housing 103.

The remainder of valve housing 103 comprises a cylindrical portion 116 having an outside diameter slightly greater than the outside diameter of valve housing portion 109.

Valve housing 103 has an axial bore 117. The axial bore 117 has a first or uppermost portion 117a which has an upwardly and outwardly flaired portion 117b. The bore portion 117a is followed by an annular shoulder 117c, leading to a portion 117d of smaller diameter. Bore portion 117d, in turn, is followed by a slightly larger diameter portion 117e, the lower portion of which is threaded as at 117f. As will be apparent hereinafter, bore portion 117a and the adjacent annular shoulder 117c constitute the valve seat.

Figure 15:
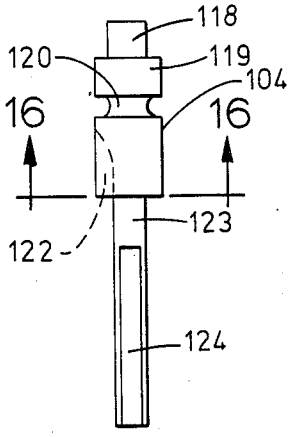
FIG. 15 is an elevational view of the stem of the safety actuated valve of FIG. 9.
Figure 16:
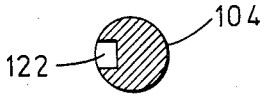
FIG. 16 is a cross sectional view taken along section line 16—16 of FIG. 15.
Figure 17:
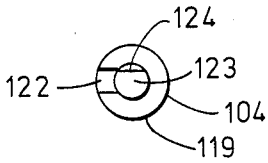
FIG. 17 is a bottom end view of the stem of the safety actuated valve of FIG. 15.

The valve stem 104 for safety actuated valve 10a is illustrated in FIGS. 15, 16, and 17. Valve stem 104 comprises an elongated member. At its upper end, the valve stem has a cylindrical nose portion 118. The nose portion 118 surmounts the main body portion 119 which is of slightly larger diameter. The main valve portion 119 has an annular groove 120 formed therein. As shown in FIG. 9, the groove 120 is adapted to accommodate an O-ring 121 which cooperates with the valve body seat 117a/117c.

As can be seen in all three of FIGS. 15–17, the main body portion 119 of valve stem 104 has a slot 122 formed therein. The upper end of slot 122 curves upwardly and outwardy to the exterior surface of main body portion 119.

The main body portion 119 of valve stem 104 is followed by a cylindrical portion 123 of lesser diameter. The portion 123 has a flat 124 formed thereon. It will be noted from FIGS. 15 and 17 that the flat 124 is oriented at 90° with respect to slot 122. The exact positioning of flat 124 does not constitute a limitation on the present invention. The purpose of flat 124 will be apparent hereinafter.

Figure 19:
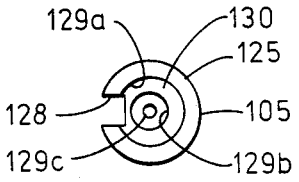
FIG. 19 is a top end view of the plunger of FIG. 18.
Figure 18:
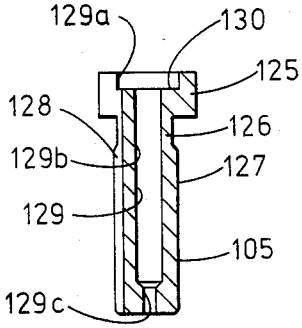
FIG. 18 is a cross sectional view of the plunger of the safety actuated valve of FIG. 9.
Figure 20:
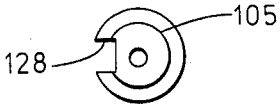
FIG. 20 a bottom end view of the plunger of FIG. 18.
Figure 21:
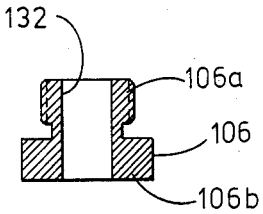
FIG. 21 a cross sectional view of the plunger retaining nut of the safety actuated valve of FIG. 9.

Plunger 105 of safety actuated valve 10a is illustrated in FIGS. 18, 19 and 20. The plunger has an upper cylindrical portion 125, followed by an annular groove 126. The remaining portion 127 of the plunger is of lesser diameter than the portion 125. A vertical slot 128 is formed in the exterior surface of plunger 105 and extends the length thereof.

The plunger 105 is provided with an axial bore 129. The axial bore has a first or uppermost portion 129a, followed by a portion 129b of lesser diameter. A shoulder 130 is formed between bore portions 129a and 129b. Finally, the bore 129 terminates in a bore portion 129c of lesser diameter than bore portion 129b. As is illustrated in FIG. 9, the bore portion 129c receives, with a friction fit, the stem of a hardened foot 131, adapted to cooperate with the actuator 9a of workpiece responsive trip 8a.

Returning to FIG. 9, when the safety actuated valve 10a is assembled, the main body portion 119 of valve stem 104 is slidably mounted in bore portion 117d of valve body 103. As indicated above, the O-ring 121 mounted in the groove 120 of valve stem 104 cooperates with the valve seat 117a/117c of valve housing 103.

The upper cylindrical portion 125 of plunger 105 is slidably mounted in the bore portion 117e of valve housing 103. The plunger 105 is retained in valve housing bore portion 117e by plunger retaining nut 106. Plunger retaining nut 106 has an upper threaded body portion 106a and a lower body portion 106b which may have a hexagonal peripheral configuration for engagement by an appropriate wrench or the like. Plunger retaining nut 106 has an axial bore 132 adapted to slidingly accommodate plunger portion 127 with clearance. The plunger retaining nut 106 is threadedly engaged in the threaded bore portion 117f of valve housing 103.

It will be noted that the elongated small diameter portion 123 of valve stem 104 is slidably received within bore portion 129b of plunger 105. Flat 124, provided on valve stem portion 123, prevents air from being trapped within bore portion 129b of plunger 105 so that valve stem portion 123 does not act like a piston therein.

Compression spring 107 is located above valve stem 104. As is clear from FIG. 9, one end of spring 107 abuts the blind upper end of bore portion 50a in guide body 5. The other end of spring 107 engages the upper surface of valve stem main body portion 119, and surrounds the valve stem nose portion 118.

Compression spring 108 surrounds the portion 123 of valve stem 104, abutting the underside of the valve stem main body portion 119. The other end of compression spring 108 rests upon the internal annular shoulder 130 of plunger 105. It will be noted that compression spring 107 urges valve stem 104 to its valve-closed position. Similarly, compression spring 108 urges plunger 105 to its lowermost position (as viewed in FIG. 9), i.e., its most extended position.

The modified trigger actuated valve 48a and the new safety actuated valve 10a having been described in detail, the operation of the fastener driving tool, modified in accordance with the present invention, can now be described.

It will be understood that in a tool incorporating the present invention, the main valve 29 functions in precisely the same manner described with respect to the prior art tool and is actuable by the remote valve 44 in the very same manner. In other words, as long as remote valve 44 remains in its unactuated position, the main valve will also remain in its unactuated position, sealing off the main cylinder 12. On the other hand, once remote valve 44 has shifted to is actuated position, the main valve will open and the piston/driver assembly 16 will drive a fastener into a workpiece.

FIG. 9 shows remote valve 44, trigger actuated valve 48a and safety actuated valve 10a in their normal, unactuated conditions. Under these circumstances, pressurized air from within the main body portion 3 of the tool acts upon the upper enlarged portion or head 63 of remote valve 44, and at the same time air under pressure entering through bleed holes 70 and 100 act upon the bottom portion of the lower enlarged member 67 of remote valve 44, in conjunction with compression spring 98, to maintain remote valve 44 in its normal, unactuated position shown in FIGS. 2, 4 and 9. Air under pressure acting upon the upper surfaces of the enlarged member 67 of remote valve 44 is not sufficient to overcome the above described forces maintaining the remote valve 44 in its normal position. The provision of additional bleed hole 100 is optional, but preferred, since it assures the presence of sufficient air under pressure beneath the enlarged portion 67 of remote valve 44. None of this pressurized air within the upper portion of trigger actuated valve body 71 bleeds into passages 99 and 58 to safety actuated valve 10*a*, since the bleed hole 91 of valve stem 74 is closed by plug 102. In fact, valve stem bleed hole 91 may be eliminated altogether in an instance where the valve is not a converted pre-existing valve, but rather is a new valve made in accordance with the teachings of this invention. With remote valve 44, trigger actuated valve 48*a* and safety actuated valve 10*a* in their normal positions, passages 99 and 58 are connected to atmosphere by way of channel 111 and hole 112 formed in valve body 103, by clearance between the main body portion 119 of valve stem 104 and valve body bore portion 117*d*, and by the elongated slot 128 formed in the peripheral surface of plunger 105. Thus, there is no pressure in passages 99 and 58.

When the tool is operated properly in accordance with the teachings of the present invention, the nose portion of the tool is first pressed against the workpiece into which a fastener is to be driven. This causes the workpiece responsive safety 8*a* to shift upwardly. The workpiece responsive safety actuator 9*a*, contacting the foot 131 of plunger 105 shifts plunger 105 upwardly, as well. Compression spring 108 is slightly stronger than compression spring 107, with the result that safety valve stem 104 will shift upwardly with plunger 105, opening safety valve 10*a* by lifting O-ring 121 from valve seat 117*a*/117*c* and shifting the upper part of slot 122 above valve seat 117*a*/117*c*. As a result of the opening of safety actuated valve 10*a*, passages 99 and 58 are now fully open to atmosphere, but remote valve 44 will not shift to its actuated position since trigger actuated valve 48*a* remains closed. When trigger 11 (see FIGS. 1, 2 and 4) is squeezed to its actuated position, it will shift valve stem 74 to its open position, lifting O-ring 94 from its valve seat 84*a*. Once trigger actuated valve 48*a* is open, air under pressure beneath the enlarged member 67 of remote valve 44 will be dumped to atmosphere via passages 99 and 58, and through open safety actuated valve 10*a*. This having been done, the force of the pressurized air within the tool main body portion 3, acting upon the upper surface of remote valve enlarged member 67, is enough to shift the remote valve 44 to its actuated position, opening main valve 29 and causing a fastener to be driven.

Considering now an instance where the manual trigger is operated to open trigger actuated valve 48*a* before the workpiece responsive safety opens safety actuated valve 10*a*. When the manual trigger 11 opens trigger actuated valve 48*a*, air from beneath the enlarged member 67 of remote valve 44 is free to enter passages 99 and 58, but will be stopped at closed safety actuated valve 10*a*. The amount of air under pressure entering into passages 99 and 58 is not sufficient to permit the shifting of remote valve 44 to its actuated position.

If, once trigger actuated valve 48*a* is open, the nose of the tool is placed upon the workpiece so that the workpiece responsive safety 8*a*, through its actuator 9*a*, shifts plunger 105 upwardly (as viewed in FIG. 9), plunger 105 will shift upwardly, but the valve stem 104 will not and therefore safety actuated valve 10*a* will not open and a fastener will not be driven into the workpiece. The reason safety valve 10*a* will not open lies in the fact that the upper end of valve stem 104 is acted upon by air under pressure from open trigger valve 48*a* via passages 99 and 58. The pressurized air acting upon the upper end of valve stem 104, in combination with compression spring 107, cannot be overcome by compression spring 108. As a result, when plunger 105 shifts upwardly as viewed in FIG. 9, compression spring 108 will simply collapse and the valve stem will remain in its valve-closed position.

It will be apparent, therefore, that the fastener driving tool, when modified in accordance with the present invention, constitutes a restrictive trigger tool. As a result, the operator cannot maintain the manual trigger in its trigger actuated valve opening position and fire the tool repeatedly by depressing the workpiece responsive safety 8*a*. In other words, both the workpiece responsive safety 8*a* and the manual trigger 11 must be actuated for the tool to drive a fastener, and in addition the workpiece responsive safety 8*a* must be actuated before the manual trigger 11. It would be possible to depress the workpiece responsive safety 8*a* against the workpiece and keep it depressed by dragging it along the workpiece, whereupon a fastener will be driven upon each actuation of manual trigger 11. This type of tool operation is awkward and difficult and not recommended. Nevertheless, it is an instance where the workpiece responsive safety is actuated before each actuation of the trigger.

A comparison of FIG. 9 and FIG. 2 clearly shows that the new safety actuated valve 10*a* is physically longer than the prior art safety actuated valve 10. As a consequence of this, it may be necessary to shorten the workpiece responsive safety 8*a* so as to properly locate its actuator 9*a* with respect to the foot 131 of the valve plunger 105.

A second embodiment of the present invention is illustrated in FIGS. 22–26. In this second embodiment, in order to convert the prior art tool of FIGS. 1–12 to a restrictive trigger tool, the original safety actuated valve is maintained without change and the trigger actuated valve is replaced by a pressure controlled trigger actuated valve to be described hereinafter. The remainder of tool 1, including main valve 29 and remote valve 44 are the same as described with respect to FIGS. 1, 2 and 4, both in structure and mode of operation.

Figure 22:
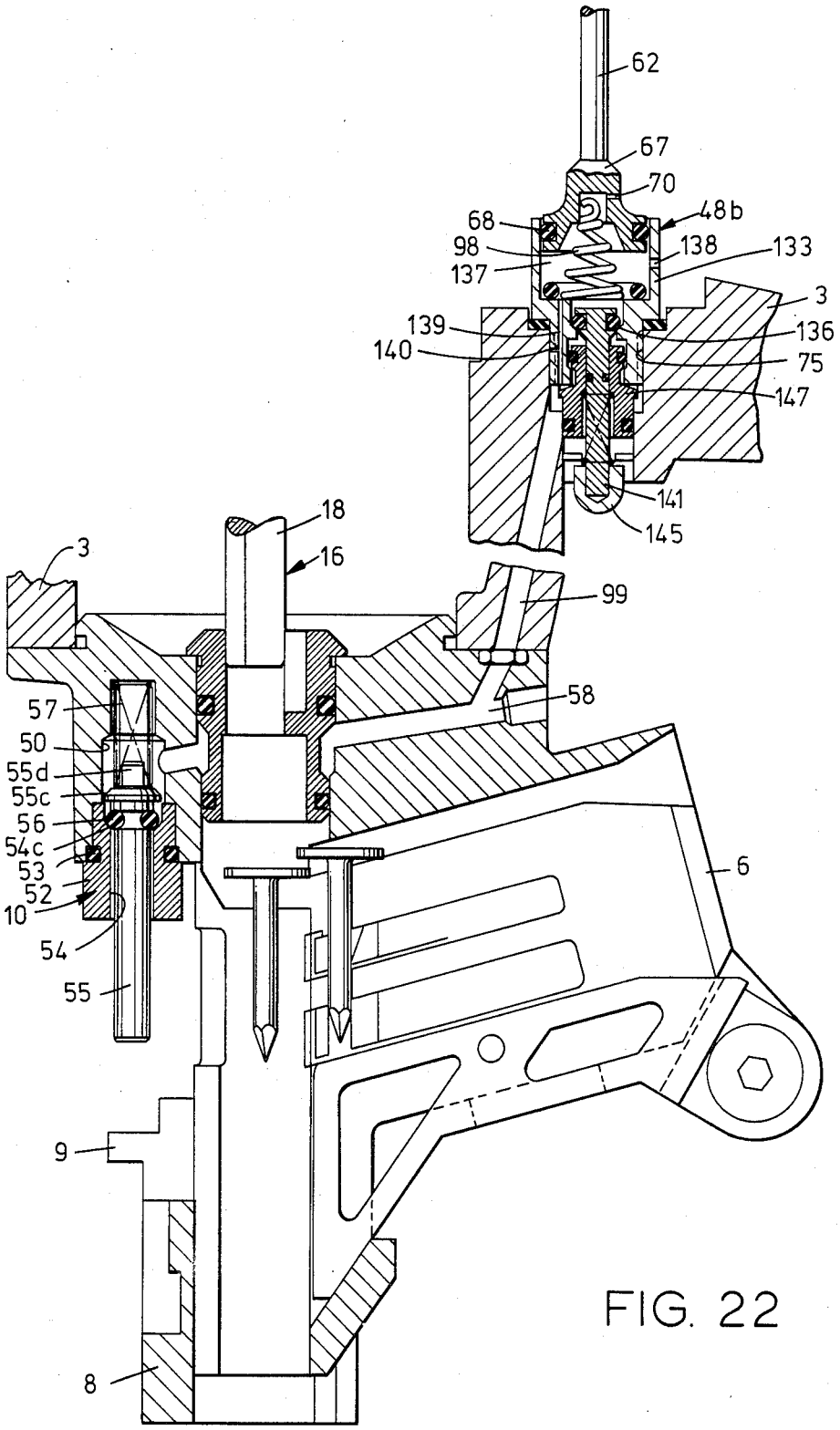
FIG. 22 is a fragmentary cross sectional view, similar to FIG. 9, and illustrating the second embodiment of the present invention.

Reference is first made to FIG. 22. It will be apparent that FIG. 22 is similar to FIG. 9, with the exceptions that the safety actuated valve 10 is identical to original safety actuated valve 10 of FIG. 3 and modified on-off type trigger actuated valve 48*a* has been replaced by new pressure controlled trigger actuated valve 48*b*.

The detailed description of the original safety actuated valve 10 of FIG. 3 will suffice for the description of safety actuated valve 10 of FIG. 22, since these valves are identical. As a consequence, like parts have been given like index numerals.

Figure 23:
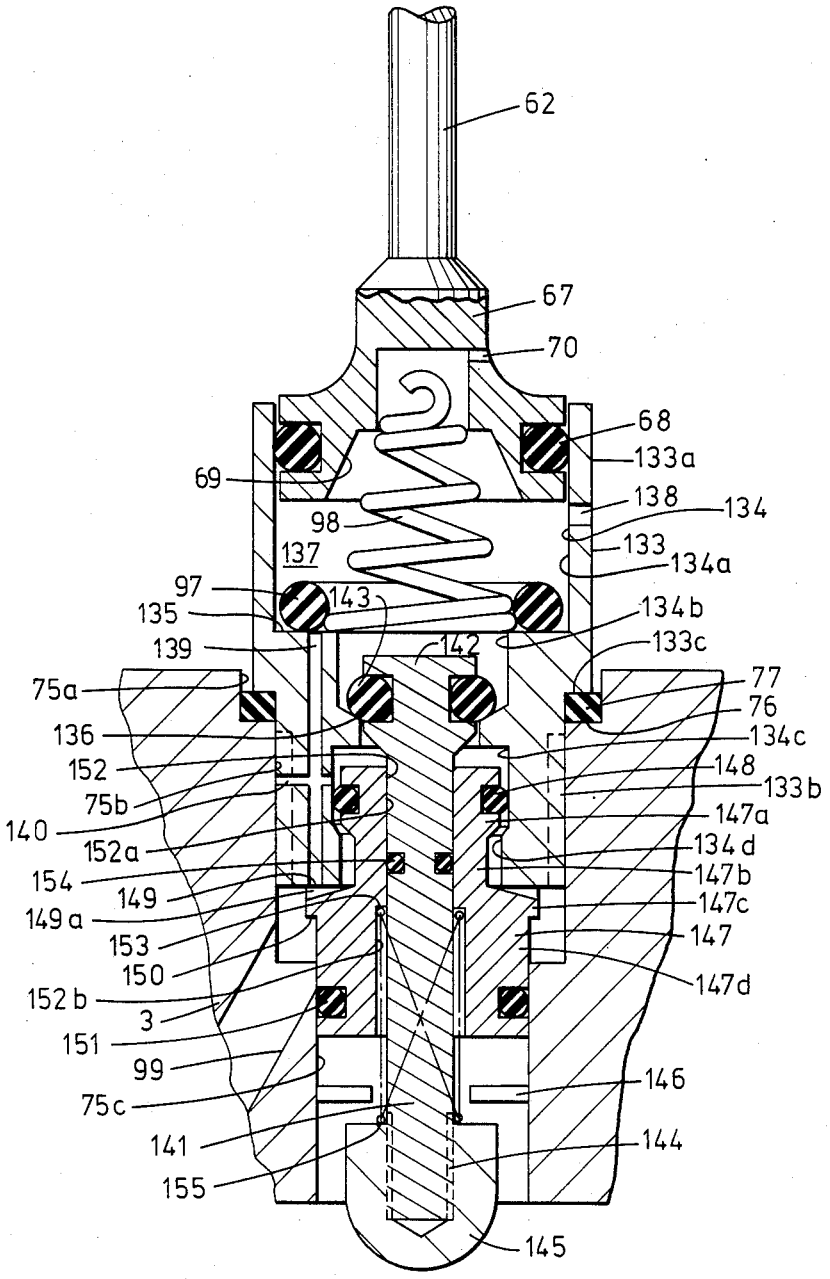
FIG. 23 is a fragmentary cross sectional view of the trigger actuated valve of the embodiment of FIG. 22, illustrating the valve parts in the positions they occupy when the tool is not connected to a source of air under pressure.

With respect to new trigger actuated valve 48*b*, reference is made to FIG. 23 wherein the valve is shown in cross section in larger scale. Trigger actuated valve 48*b* comprises a valve housing 133. The valve housing 133 constitutes a cylindrical member having an upper portion 133*a* and a lower portion 133*b* of lesser diameter. An exterior shoulder 133*c* is formed between the portions 133*a* and 133*b*. The lower portion 133*b* is externally threaded so that it can be threadedly engaged in the threaded portion 75b of the bore 75 in the tool main body portion 3. It will be noted from FIG. 23 that a washer 77 is located between the valve housing shoulder 133c and the shoulder 76 formed between bore portions 75a and 75b in the tool main body portion 3. This assures a fluid tight seal between valve housing 133 and main body portion 3.

Valve housing 133 is provided with an axial bore 134 having a first portion 134a, followed by a lesser diameter portion 134b with a shoulder 135 formed therebetween. Valve housing bore portion 134b terminates at an annular valve seat 136. Valve seat 136 is followed by bore portion 134c which can be of the same diameter as bore portion 134b. The bore portion 134c terminates in a bore portion 134d of slightly lesser diameter.

As is shown in FIG. 23, bore portion 134a is adapted to receive the lower enlarged member 67 of valve stem 62 of remote valve 44. The O-ring 68 of enlarged member 67 sealingly engages the inside surface of bore portion 134a. The O-ring 97 rests on the shoulder 135 of valve housing 48b and serves as a bumper for the enlarged member 67 of the remote valve stem 62. As is true of the structure of FIG. 9, the compression spring 98 is located within bore portion 134a. The compression spring 98 extends upwardly into the bore 69 of the enlarged member 67 of the remote valve stem 62 and seats therein. The other end of compression spring 98 rests upon the shoulder 135 of valve housing 48b.

As in the case of the embodiment of FIG. 9, the bore portion 134a and the enlarged member 67 of the remote valve stem 62 define a chamber 137. Air under pressure from within the main body portion 3 can enter chamber 137 through bleed hole 70 in the enlarged member 67 of remote valve stem 62 and through an additional bleed hole 138 formed in the portion 133a of valve housing 133.

The valve housing 133 is completed by a bleed passage 139 which extends from the chamber 137 through the lower end of the valve housing 133. The bleed passage 139 is intersected by a transverse bleed passage 140 extending from the exterior of valve housing portion 133 to bore portion 134c, beneath valve seat 136. The purposes of bleed passages 139 and 140 will be apparent hereinafter.

Trigger actuated valve 48b is provided with a valve stem 141. The valve stem 141 comprises an elongated shaft-like member terminating at its upper end in an enlarged head 142 supporting an O-ring 143 adapted to cooperate with valve seat 136. The lowermost end of valve stem 141 is threaded, as at 144, and has a hardened foot 145 threadedly engaged thereon for cooperation with the manual trigger 11 (not shown). It will be noted in FIG. 23 that the ring member 93 (see FIG. 9) has been removed from the bore portion 75c in the tool main body portion 3 and has been replaced by an annular, washer-like trigger limiting device 146, which limits the vertical travel of valve stem 141, and therefore the amount of vertical shifting of manual trigger 11.

The new trigger actuated valve 48b is completed by a cylindrical cage 147. The cage 147 has an uppermost portion 147a carrying an O-ring 148. The portion 147a is followed by a portion 147b of lesser diameter. A portion of maximum diameter 147c follows the portion 147b and forms a shoulder 149 therebetween. The shoulder 149 is provided with a plurality of radial grooves 149a serving as air passages. The portion 147c is followed by a final portion 147d of a lesser diameter such as to be slidably received in bore portion 75c of the tool main body portion 3. A shoulder 150 is formed between cage portions 147c and 147d. Finally, the cage portion 147d carries an O-ring 151, sealingly engaging the surface of bore portion 75c in the tool main housing portion 3.

Cage 147 has an axial bore 152. The bore 152 has an upper portion 152a followed by a lower portion 152b of greater diameter, with a shoulder 153 formed therebetween. The upper bore portion 152a is so sized as to slidably receive valve stem 141. The valve stem 141 carries an O-ring 154 which sealingly engages the bore portion 152a of cage 147. The lower portion 152b of the cage bore accommodates a compression spring 155, surrounding valve stem 141. One end of compression spring 155 abuts the bore shoulder 153 of cage 147. The other end of compression spring 155 abuts the valve stem fit 145.

In this second embodiment of the present invention, all of the parts necessary to actuate the remote valve 44, and thus the main valve 29, have been described. As a consequence, the operation of the second embodiment of the present invention can now be set forth.

Turning first to FIG. 22, the safety actuated valve 10 is shown in its closed position, with the valve stem O-ring 56 abutting valve seat 54c. When the valve stem is opened by actuator 9 of workpiece responsive safety 8, it will connect passages 99 and 58 to atmosphere.

FIG. 23 illustrates the trigger actuated valve with its parts in the positions they occupy when the tool 1 is not connected to a supply of air under pressure. It will be noted that valve stem 141 is in its valve-closed position with its O-ring 143 abutting valve seat 136. At the same time, valve cage 147 is in its uppermost position determined by abutment of its annular shoulder 149 against the bottom of valve housing 133. The valve stem 141 and the valve cage 147 are held in these positions by compression spring 155.

Figure 24:
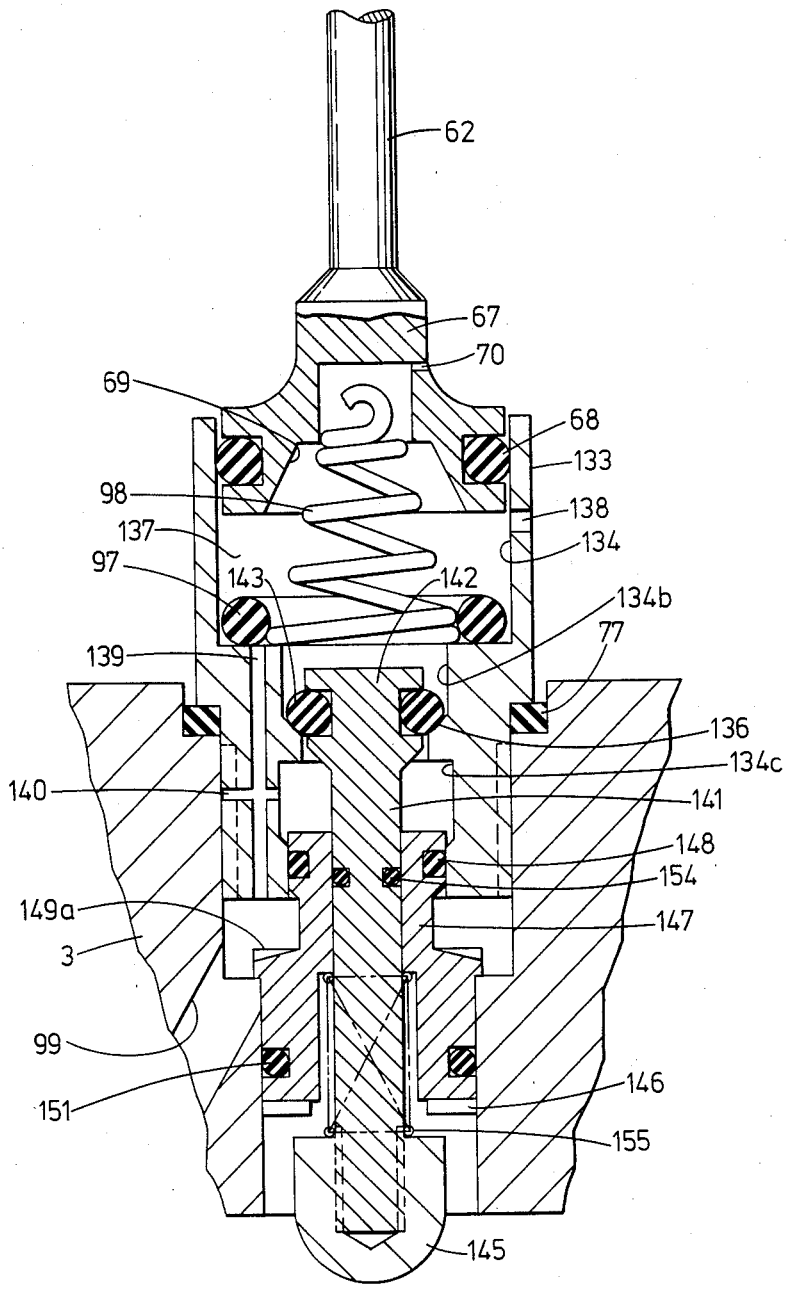
FIG. 24 is a fragmentary cross sectional view of the trigger actuated valve of FIG. 22, illustrating the valve parts in the positions they occupy when the tool is connected to a source of air under pressure and when the safety actuated valve and the tool trigger are unactuated.

FIG. 24 illustrates the positions of the valve stem and the valve cage when the tool 1 has been connected to a source of air under pressure and when the safety actuated valve 10 and the manual trigger 11 have not been actuated. It will be noted that the valve stem 141 is in its closed position. The valve stem 141 is held in its closed position by pressurized air in chamber 137 provided from the main body portion 3 of the tool by bleed hole 70 in remote valve stem enlarged member 67 and bleed hole 138 in valve housing 133. Air under pressure also passes through bleed passages 139 and 140 into bore portion 134c below valve seat 136 and in the area beneath valve housing 133 including passages 58 and 99. Since the safety actuated valve 10 is closed, the pressurized air from bleed passages 138 and 140 is not lead away to atmosphere. This air under pressure acts upon the uppermost surface of cage 147 and the shoulder 149 of cage 147 to shift the cage to its lower position, determined by abutment of cage shoulder 150 against the shoulder 75d of the bore 75 in the main body portion 3. When cage 147 is in its lowermost position, its O-ring 148 sealingly engages valve housing bore portion 134d. Air under pressure within bore portion 134c, under valve seat 136, will act upon the underside of valve stem head 142. However, the area of the underside of valve stem head 142 is far less than the upper surface of valve stem head 142, and therefore the valve stem 141 will remain in its closed position.

FIG. 23 also illustrates the positions of the valve stem 141 and the valve cage 147 upon the opening of safety actuated valve 10 and before actuation of manual trigger 11. Under these circumstances, passages 58 and 99 are connected to atmosphere by the safety-actuated valve. As a result of this, the volume under valve housing 133 and the volume within valve housing bore portion 134*c* will be vented to atmoshere via bleed passages 139 and 140, passages 99 and 58, and safety actuated valve 10. As a consequence of this, the valve cage 147 will shift to its uppermost position under the influence of compression spring 155. Valve stem 141 will remain in its closed position.

Figure 25:
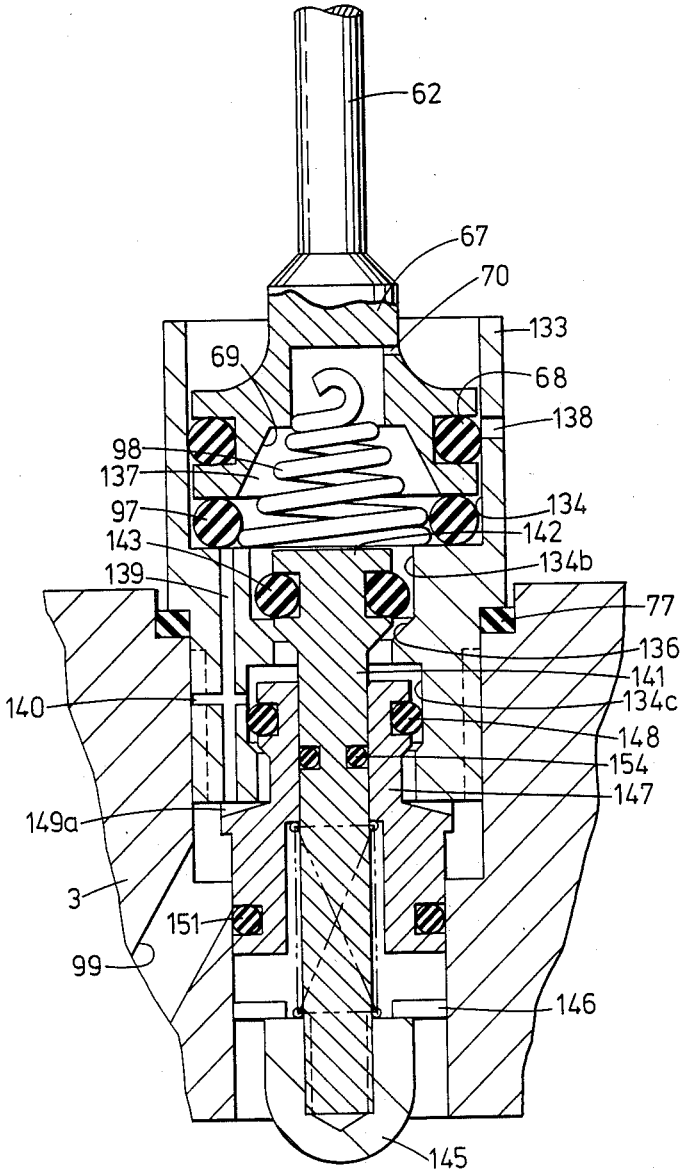
FIG. 25 is a fragmentary cross sectional view of the trigger actuated valve of FIG. 22, illustrating the valve parts in the positions they occupy once the trigger has been operated after actuation of the safety actuated valve.

FIG. 25 illustrates the position of the valve stem 141 and the valve cage 147 when manual trigger 11 has been actuated after the opening of safety actuated valve 10 (i.e., when the safety actuated valve 10 and the manual trigger 11 have both been actuated, in proper sequence). Actuation of manual trigger 11 will shift valve stem 141 to its open position, shifting valve stem O-ring 143 away from valve seat 136. The valve cage 147 will remain in its uppermost position, and as a result, air under pressure within chamber 137 will be vented past the valve stem 141 and the valve seat 136 and past the upper portion of valve cage 147, through valve cage grooves 149*a*, passages 99 and 58, and safety actuated valve 10 to atmosphere. With the pressurized air vented from chamber 137, remote valve stem 62 will shift downwardly under the influence of pressurized air within the main body portion 3 of tool 1, acting against the outer surface of the remote valve stem enlarged member 67. Downward movement of the remote valve stem 62 will actuate the remote valve 44 resulting in actuation of main valve 29 and the driving of a fastener into the workpiece. When the manual trigger 11 or the safety actuated valve 10 (or both) are returned to their normal, unactuated conditions, the flow of pressurized air from within the main body portion 3 through the bleed hole 70 in the enlarged member 67 of remote valve stem 62 and through the bleed hole 138 in the valve housing 133 will restore pressure in chamber 137 and shift the remote valve stem 62 to its normal, unactuated position.

In an instance where the manual trigger is actuated before the safety actuated valve is operated, a situation would result similar to that illustrated in FIG. 24, with the exception that the valve stem 141 would be in its open position. With the valve stem 141 in its open position, there is a direct opening between the top and bottom of the valve stem head 142, both of which are at the same pressure. Pressurized air acting upon the uppermost surface of valve cage 147 and on its shoulder 149 from bleed passage 139 is sufficient to maintain the valve cage 147 in the position shown in FIG. 24 with its O-ring 148 sealingly engaging the valve housing bore portion 134*d*. Pressurized air from bleed passage 139 cannot lift the valve cage 147 since the areas of its uppermost surface and the surface of its shoulder 149 are far greater than the area beneath its uppermost end.

Figure 26:
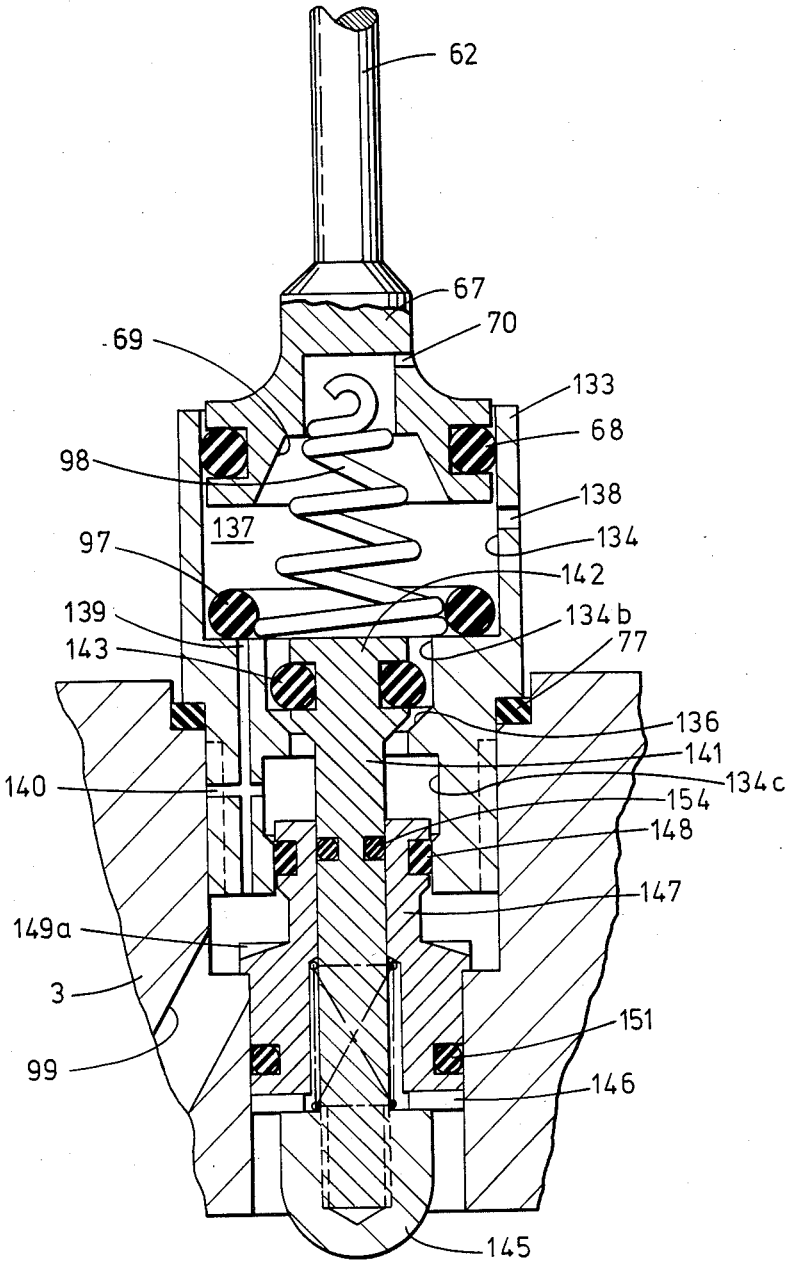
FIG. 26 is a fragmentary cross sectional view of the trigger actuated valve of FIG. 22, illustrating the parts thereof in the positions they occupy in an instance where the manual trigger has been actuated before the safety actuated valve has been actuated.

At this point, should the safety actuated valve be operated in an attempt to bottom-fire the tool, the conditions of FIG. 26 would be established. Operation of the safety actuated valve releases the pressurized air from bleed passage 139 to atmosphere. Nevertheless, pressurized air operating on the uppermost surface of the valve cage will maintain the valve cage in its sealing position illustrated in FIG. 26. Thus, upon operation of the safety actuated valve, only the bleed flow from bleed passage 139 escapes through the safety actuated valve. In order to reset the tool to its normal idle position shown in FIG. 24, both the safety actuated valve and the manual trigger 11 must be released and returned to their normal, unactuated positions.

It will be evident that the fastener driving tool 1, when modified in accordance with the second embodiment just described, will constitute a restrictive trigger tool. The operator cannot maintain manual trigger 11 in its trigger actuated valve opening position and fire the tool repeatedly by depressing the workpiece responsive safety 8. Both the workpiece responsive safety 8 and the manual trigger 11 must be actuated in order to drive a fastener, and the workpiece responsive safety 8 must be actuated before the manual trigger 11.

As in the case of the first embodiment, it would be possible in the second embodiment to depress the workpiece responsive safety 8 against a workpiece and keep it depressed by dragging it along the workpiece, whereupon a fastener will be driven upon each actuation of manual trigger 11. As indicated above, however, this type of tool operation is awkward and difficult and not recommended.

Modifications may be made in the invention without departing from the spirit of it. For example, in the first embodiment, additional bleed hole 100 in valve body 71 of trigger actuated valve 48*a* is optional. The same is true of bleed hole 138 of valve body 133 in the second embodiment. The presence of the bleed holes 100 and 138, however, is preferred. In the first embodiment it would also be possible to operate the new safety actuated valve utilizing the prior art trigger actuated valve wherein the stem 74 has bleed passages 91 and 92. Again, however, it is preferred to block passage 91 or simply to eliminate passages 91 and 92 in newly constructed trigger actuated valves.

As used herein and in the claims, such words as "upwardly", "downwardly", "vertical", "upper", "lower", "above" and "below" are employed in conjunction with the Figures. It will be understood by one skilled in the art that the tool 1 can be held in any orientation during use.

What we claim is:

1. In a fastener driving tool of the type having a body connected to a source of air under pressure, a manual trigger, a workpiece responsive safety, a cylinder and piston/driver assembly for driving a fastener, a main valve which when actuated opens said cylinder to said air under pressure causing said piston/driver assembly to drive a fastener, a remote valve which when actuated causes said main valve to open, and a trigger actuated valve together with a safety actuated valve which when both are opened actuate said remote valve, said trigger actuated valve comprising a valve body and a stem therein shiftable by said trigger between open and closed positions, said valve body of said trigger actuated valve defining a chamber, said remote valve comprising a body and a stem mounted therein and shiftable therein between actuated and unactuated positions, one end of said remote valve stem being slidably and sealingly engaged in said chamber of said trigger valve, a compression spring within said chamber beneath said remote valve stem end, a bleed passage in said end of said remote valve stem permitting air under pressure within said tool body to enter said chamber and in conjunction with said compression spring to maintain said remote valve stem in its unactuated position, said safety actuated valve comprising a valve body and a stem therein shiftable by said safety between open and closed positions, a passage in said tool body connecting said trigger actuated valve to said safety actuated valve, said chamber being connected to said passage when said trigger actuated valve stem is in its open position, said passage being connected to atmosphere when said safety actuated valve stem is in its open position, the improvement comprising one of said trigger actuated valve and said safety actuated valve being an on-off valve and the other of said trigger actuated valve and said safety actuated valve being a pressure controlled valve, means in said pressure controlled valve precluding connection of said chamber to atmosphere via said passage to shift said remote valve stem to its actuated position unless said valve stem of said safety actuated valve is shifted to its open position by said safety prior to the shifting of said valve stem of said actuated trigger valve to its open position by said manual trigger.

2. The fastener driving tool claimed in claim 1 wherein said safety actuated valve comprises said pressure controlled valve and said trigger actuated valve comprises said on-off valve.

3. The fastener driving tool claimed in claim 2 wherein said body of said safety actuated valve is operatively connected to said passage, means in said valve body to vent said passage to atmosphere when said valve stem of said safety actuated valve is in its closed position, first biasing means to bias said valve stem of said safety actuated valve to its closed position, a plunger captively and slidably mounted in said body of said safety actuated valve and shiftable therein by said safety from an unactuated position wherein a portion of said plunger extends exteriorly of said safety actuated valve toward said safety and an actuated position wherein said plunger is shifted inwardly of said body of said safety actuated valve by said safety, second biasing means biasing said plunger to its unactuated position and operatively connecting said plunger to said last mentioned valve stem, said second biasing means being of such strength as to shift said last mentioned valve stem, against the action of said first biasing means, from its closed to its open position as said safety shifts said plunger from its unactuated to its actuated position when said passage is at atmospheric pressure, said second biasing means being of insufficient strength to shift said last mentioned valve stem from its closed to its open position against the combination of the action of said first biasing means and air under pressure in said passage from said tool body, should said trigger actuated valve be opened before said safety actuated valve.

4. The fastener driving tool claimed in claim 3 including a bleed hole formed in said body of said trigger actuated valve permitting pressurized air from said tool body to enter said chamber.

5. The fastener driving tool claimed in claim 3 wherein said valve stem of said trigger actuated valve has a bleed hole formed therein permitting air from said chamber to constantly bleed into said passage, and means to plug said last mentioned bleed hole.

6. The fastener driving tool claimed in claim 2 wherein said body of said safety actuated valve has an upper end portion threadedly engaged in a bore in said tool body, said tool body bore having a blind end, said passage communicating with said tool body bore above said body of said safety actuated valve, said body of said safety actuated valve having a lower end extending toward said safety, said body of said safety actuated valve having an axial bore extending the length thereof and defining a seat at the upper end of said body of said safety actuated valve, and having an upper portion following said seat and a lower portion of greater diameter following said upper portion and forming an annular interior shoulder therebetween, said lower bore portion being internally threaded near said lower end of said safety actuated valve body, said body of said safety actuated valve having a notch formed in its exterior surface extending from the upper end thereof longitudinally to an intermediate position wherein it communicates with said upper valve body bore portion below said valve seat via a perforation in said body of said safety actuated valve, said stem of said safety actuated valve being shiftably mounted in said bore of said safety actuated valve, said last mentioned valve stem having a cylindrical body portion and an elongated shaft portion, said body portion being shiftable within said valve body upper bore portion of said safety actuated valve with clearance, an O-ring mounted about said valve stem body portion and being so positioned as to engage said valve seat when said last mentioned valve stem is in said closed position and being spaced from said valve seat when said last mentioned valve stem is in said open position, said valve stem body portion having upper and lower ends, said valve stem body portion having a nose formed on its upper end, means biasing said valve stem to its closed position, said biasing means comprising a first compression spring having a first end surrounding said nose and abutting said upper end of said valve stem body portion and a second end abutting said blind end of said tool body bore, said valve stem body portion having a slot formed in its exterior cylindrical surface and extending longitudinally from said bottom end of said valve stem body portion to a position adjacent said O-ring thereon, said slot being wholly below said valve seat when said last mentioned valve stem is in its closed position, a part of said slot extending above said valve seat when said last mentioned valve stem is in its open position, said elongated shaft portion of said last mentioned valve stem being cylindrical and of less diameter than said valve stem body portion and extending coaxially from said valve stem body portion lower end, a plunger having an elongated cylindrical body with an upper end having a surrounding peripheral flange and a lower end, said plunger having an axial bore extending from its upper end to a point just short of its lower end, said plunger being mounted on said valve stem shaft portion with said shaft portion slidably received in said plunger bore, said plunger and its annular flange being axially shiftable in said lower portion of said bore in said body of said safety actuated valve, a retaining nut threadedly engaged in said lower portion of said valve body bore, said retaining nut having an axial bore slidably receiving said plunger body, a second compression spring surrounding said valve stem shaft portion, one end of said second compression spring abutting said bottom end of said valve stem body portion, the other end of said second compression spring abutting said plunger flange, said second compression spring biasing said plunger to a normal unactuated position wherein its flange abuts said retaining nut and its lower end extends beyond said retaining nut toward said safety, said plunger having a longitudinal slot formed in its flange and the exterior surface of its body and extending the length thereof, when said trigger actuated valve is closed and said safety actuated valve is closed with its plunger in its normal extended position, said passage and said bore of said tool body above said safety actuated valve are at atmospheric pressure, being vented to atmosphere by said safety actuated valve body notch and perforation, said clearance between said upper portion of said valve body bore and said valve stem body portion and said plunger slot, said second compression spring being of such strength as to shift said last mentioned valve stem to its open position against the action of said first compression spring when said plunger is shifted toward said valve seat by said safety, when said plunger is shifted from its unactuated position by said safety, said second compression spring is of insufficient strength to shift said last mentioned valve stem to its open position against the action of said first compression spring and air under pressure in said passage and said tool body bore above said safety actuated valve when said trigger actuated valve is opened before said safety actuated valve.

7. The fastener driving tool claimed in claim 6 including bleed hole formed in said body of said trigger actuated valve permitting pressurized air from said tool body to enter said chamber.

8. The fastener driving tool claimed in claim 6 wherein said valve stem of said trigger actuated valve has a bleed hole formed therein permitting air from said chamber to constantly bleed into said passage, and means to plug said last mentioned bleed hole.

9. The fastener driving tool claimed in claim 1 wherein said trigger actuated valve comprises said pressure controlled valve and said safety actuated valve comprises said on-off valve.

10. The fastener driving tool claimed in claim 3 including a valve seat in said body of said trigger actuated valve, an O-ring mounted on said valve stem of said trigger actuated valve and which is so positioned thereon as to engage said seat when said last mentioned valve stem is in its closed position and is spaced from said seat when said last mentioned valve stem is shifted to its open position by said manual trigger, said chamber defined by said trigger actuated valve body being located above said valve seat, said valve body of said trigger actuated valve extending below said valve seat and terminating in a lower end connected to said passage to said safety actuated valve, a cylindrical valve cage slidably mounted on said valve stem of said trigger actuated valve, said cage being shiftable between a closed position wherein it seals said lower end of said valve body of said trigger actuated valve and an open position wherein it opens said valve body lower end, biasing means biasing said cage to its open position, a first bleed hole in said valve body of said trigger actuated valve extending from said chamber through said valve body lower end and having a lateral branch communicating with the interior of said last mentioned valve body below said valve seat, when said safety actuated valve is in its closed position, pressurized air from said chamber via said first bleed hole is present in said passage between said trigger actuated valve and said safety actuated valve and in said trigger actuated valve body below its valve seat normally maintaining said cage in its closed position against the action of said biasing means and precluding opening of said trigger actuated valve with said trigger actuated valve stem in either of its closed and open positions, whereby said safety actuated valve must be opened before said trigger actuated valve to connect said pressurized air from said first bleed hole to atmosphere and to permit shifting of said cage to its open position by said biasing means to enable said trigger actuated valve to be opened by shifting of said valve stem thereof to its open position, said cage being maintained in its closed position by pressurized air from said chamber when said valve stem of said trigger actuated valve be opened before said valve stem of said safety actuated valve.

11. The fastener driving tool claimed in claim 1 including a second bleed hole formed in said valve body of said trigger actuated valve permitting pressurized air from said tool body to enter said chamber.

12. The fastener driving tool claimed in claim 3 wherein said trigger actuated valve body is mounted in a bore extending through said tool body adjacent said manual trigger, said tool body bore having a first portion extending from its interior, a second intermediate threaded portion of lesser diameter than said first portion and a third portion of lesser diameter than said second portion, a first annular shoulder formed in said body between said first and second bore portions and a second annular shoulder formed in said body between said second and third bore portions, said body of said trigger actuated valve being cylindrical and having an upper portion and a lower externally threaded portion of lesser diameter with an annular shoulder formed therebetween, said lower portion of said last mentioned valve body being threadedly engaged in said second portion of said tool body bore with a sealing washer located between said valve body shoulder and said first shoulder of said tool body bore, said lower portion of said last mentioned valve body terminating short of said second tool body annular shoulder, said passage between said safety actuated valve and said trigger actuated valve intersecting said second tool body bore portion adjacent said second shoulder thereof and below said lower portion of said last mentioned valve body, said last mentioned valve body having an axial bore comprising a first portion defining said chamber, a second portion therebelow of lesser diameter, a valve seat below said second portion, a third portion below said valve seat and a fourth portion of lesser diameter than said third portion, said valve stem of said trigger actuated valve comprising an elongated member having upper and lower ends, said last mentioned valve stem being axially shiftable within said valve body bore by said manual trigger between its open and closed positions, an O-ring mounted on said upper end of said last mentioned valve stem and engaging said valve seat when said last mentioned valve stem is in its closed position, said lower end of said last mentioned valve stem extending through said third portion of said bore in said tool body, a cylindrical valve cage, said cage having a first uppermost portion of an external diameter such as to be slidably receivable in said fourth valve body bore portion, an O-ring mounted on said first cage portion to sealingly engage said fourth valve body bore portion, a second cage portion below said first cage portion and of lesser external diameter, a third cage portion below said second cage portion and having an external diameter greater than said fourth valve body bore portion and said third tool body bore portion, said third cage portion comprising an annular laterally extending flange having a plurality of radial air passage grooves formed on its upper surface, a fourth cage portion below said cage shoulder and of lesser external diameter such as to be slidably received in said third tool body bore portion, an O-ring on said fourth cage portion sealingly engaging said third tool body bore portion, said cage having an axial bore having a first upper portion of an internal diameter such that said last mentioned valve stem is slidably received therein, an O-ring mounted on said last mentioned valve stem sealingly engaging said first axial bore portion of said cage, said axial bore of said cage having a second lower bore portion of greater diameter than said first cage bore portion with an annular internal shoulder formed therebetween, a foot mounted on said lower end of said last mentioned valve stem, a compression spring mounted on said last mentioned valve stem and having a first end abutting said foot and a second end abutting said cage internal shoulder, a first bleed hole in said last mentioned valve body extending from said chamber through the end of said second portion of said last mentioned valve body and having a lateral branch communicating with said valve body third bore portion beneath said seat, said cage being shiftable between an open position with its external annular shoulder abutting second portion of said last mentioned valve body and a closed position with its external annular shoulder abutting the second shoulder of said tool body bore and said O-ring on said first portion of said cage sealingly engaging said fourth axial bore portion of said last mentioned valve body, when said safety actuated valve is in its closed position pressurized air from said chamber via said first bleed hole is present in said passage between trigger actuated valve and said safety actuated valve and said trigger actuated valve body below its valve seat normally maintaining said cage in its closed position against the action of said compression spring and precluding opening of said trigger actuated valve with said trigger actuated valve stem in either of its closed and open positions, whereby said safety actuated valve must be opened before said trigger actuated valve to connect said pressurized air from said first bleed hole to atmosphere and to permit shifting of said cage to its open position by said compression spring to enable said trigger actuated valve to be opened by shifting of said valve stem thereof to its open position, said cage being maintained in its closed position by pressurized air from said chamber when said valve stem of said trigger actuated valve is opened before said valve stem of said safety actuated valve.

13. The fastener driving tool claimed in claim 12 including a second bleed hole formed in said first position of said valve body first portion of said trigger actuated valve permitting pressurized air from said tool body to enter said chamber.

* * * * *